US009670038B2

(12) United States Patent
Boutwell, Jr.

(10) Patent No.: US 9,670,038 B2
(45) Date of Patent: Jun. 6, 2017

(54) DRILLING RIG TRANSFER SYSTEM AND METHOD

(71) Applicant: Devin International, Inc., Lafayette, LA (US)

(72) Inventor: Doyle Frederic Boutwell, Jr., Houston, TX (US)

(73) Assignee: Devin International, Inc., Lafayette, LA (US)

( * ) Notice: Subject to any disclaimer, the term of this patent is extended or adjusted under 35 U.S.C. 154(b) by 249 days.

(21) Appl. No.: 14/273,632

(22) Filed: May 9, 2014

(65) Prior Publication Data

US 2014/0332487 A1 Nov. 13, 2014

Related U.S. Application Data

(60) Provisional application No. 61/821,942, filed on May 10, 2013, provisional application No. 61/872,987, filed on Sep. 3, 2013.

(51) Int. Cl.
*E21B 19/02* (2006.01)
*B66C 19/00* (2006.01)
(Continued)

(52) U.S. Cl.
CPC ..... *B66C 19/00* (2013.01); *B66C 7/04* (2013.01); *B66C 9/18* (2013.01); *B66C 11/06* (2013.01); *E21B 19/02* (2013.01)

(58) Field of Classification Search
CPC combination set(s) only.
See application file for complete search history.

(56) References Cited

U.S. PATENT DOCUMENTS 295,172 A * 3/1884 Hill ..... B66C 11/06 186/29
1,557,070 A * 10/1925 Logue ..... B66C 7/00 104/126
(Continued)

FOREIGN PATENT DOCUMENTS

CN 101476312 7/2009
CN 102536267 7/2012
(Continued)

OTHER PUBLICATIONS

International Search Report for counterpart International Application No. PCT/US2014/037431.
(Continued)

*Primary Examiner* — Cathleen Hutchins
*Assistant Examiner* — Ronald Runyan
(74) *Attorney, Agent, or Firm* — Winthrop & Weinstine, P.A.

(57) ABSTRACT

A drilling rig transfer system includes a mobile transfer beam, a trolley assembly operatively attached to and moveable along the mobile transfer beam, and a connection mechanism suspended from the trolley assembly for connecting to and lifting a device. The mobile transfer beam is suspended from first and second traveling blocks through connections at first and second suspension positions along the mobile transfer beam. A method of transferring a device may include suspending a connection mechanism from the trolley assembly over a first location, lowering and attaching the connection mechanism to a device disposed at the first location, lifting the device with the connection mechanism, moving the trolley assembly along the mobile transfer beam to position the connection mechanism and the device over a second location, and lowering the connection mechanism and the device into the second location.

22 Claims, 24 Drawing Sheets

(51) Int. Cl.

| | |
|---|---|
| ***B66C 7/04*** | (2006.01) |
| ***B66C 9/18*** | (2006.01) |
| ***B66C 11/06*** | (2006.01) |

(56) References Cited

U.S. PATENT DOCUMENTS

| | | | | |
|---|---|---|---|---|
| 2,420,803 | A | | 5/1947 | Tobin |
| 2,657,017 | A | | 10/1953 | Curtis |
| 2,663,375 | A | | 12/1953 | Caldwell |
| 2,781,108 | A | | 2/1957 | Selberg et al. |
| 3,063,509 | A | | 11/1962 | Guier |
| 3,099,323 | A | | 7/1963 | Kelley |
| 3,228,151 | A | | 1/1966 | Woolslayer et al. |
| 3,327,997 | A | | 6/1967 | Zenke |
| 3,333,377 | A | | 8/1967 | Woolslayer et al. |
| 3,774,780 | A | * | 11/1973 | Buffington ..... E21B 19/155 104/112 |
| 3,828,513 | A | | 8/1974 | Vanderklaauw |
| 3,922,825 | A | | 12/1975 | Eddy et al. |
| 3,942,593 | A | | 3/1976 | Reeve et al. |
| 3,949,818 | A | | 4/1976 | Russell |
| 3,977,542 | A | * | 8/1976 | Stolzer ..... B65G 1/10 414/281 |
| 4,128,229 | A | | 12/1978 | Elliston |
| 4,135,340 | A | | 1/1979 | Cox et al. |
| 4,269,395 | A | | 5/1981 | Newman et al. |
| 4,290,495 | A | | 9/1981 | Elliston |
| 4,366,650 | A | | 1/1983 | Patterson |
| 4,375,241 | A | | 3/1983 | Gallon |
| 4,375,892 | A | | 3/1983 | Jenkins et al. |
| 4,421,447 | A | | 12/1983 | Gudgel |
| 4,587,778 | A | | 5/1986 | Woolslayer et al. |
| 4,823,870 | A | | 4/1989 | Sorokan |
| 4,831,795 | A | | 5/1989 | Sorokan |
| 4,837,992 | A | | 6/1989 | Hashimoto |
| 4,885,893 | A | | 12/1989 | Wasterval, Jr. et al. |
| 5,216,867 | A | | 6/1993 | Wasterval, Jr. et al. |
| 5,492,436 | A | | 2/1996 | Suksumake |
| 5,954,453 | A | | 9/1999 | Thomas |
| 6,045,297 | A | | 4/2000 | Voorheese et al. |
| 6,412,576 | B1 | | 7/2002 | Meiners |
| 6,634,436 | B1 | | 10/2003 | Desai |
| 6,994,171 | B2 | | 2/2006 | Orr et al. |
| 7,360,589 | B2 | | 4/2008 | Moncus |
| 7,584,809 | B1 | | 9/2009 | Flud |
| 7,765,749 | B2 | | 8/2010 | Palidis |
| 7,931,076 | B2 | | 4/2011 | Ditta et al. |
| 8,047,303 | B2 | | 11/2011 | Donnally et al. |
| 8,468,753 | B2 | | 6/2013 | Donnally et al. |
| 8,516,751 | B2 | | 8/2013 | Konduc et al. |
| 8,549,815 | B2 | | 10/2013 | Donnally et al. |
| 8,555,564 | B2 | | 10/2013 | Wasterval |
| 8,556,003 | B2 | | 10/2013 | Souchek |
| 9,091,126 | B2 | | 7/2015 | Thiessen et al. |
| 9,109,399 | B2 | | 8/2015 | Murr et al. |
| 2002/0185319 | A1 | | 12/2002 | Smith |
| 2003/0102166 | A1 | | 6/2003 | Jortveit |
| 2003/0147726 | A1 | | 8/2003 | Tolmon et al. |
| 2003/0172599 | A1 | | 9/2003 | Frink |
| 2004/0211598 | A1 | | 10/2004 | Palidis |
| 2004/0240973 | A1 | | 12/2004 | Andrews et al. |
| 2006/0180564 | A1 | | 8/2006 | Keppel |
| 2009/0000218 | A1 | | 1/2009 | Lee et al. |
| 2009/0188677 | A1 | | 7/2009 | Ditta et al. |
| 2009/0321135 | A1 | | 12/2009 | Vora |
| 2010/0150660 | A1 | | 6/2010 | Nadarajah et al. |
| 2011/0072737 | A1 | | 3/2011 | Wasterval |
| 2011/0114386 | A1 | | 5/2011 | Souchek |
| 2011/0280104 | A1 | | 11/2011 | McClung, III |
| 2013/0180186 | A1 | | 7/2013 | Konduc et al. |
| 2013/0269268 | A1 | | 10/2013 | Thiessen et al. |
| 2013/0305632 | A1 | | 11/2013 | Rivera et al. |
| 2013/0340572 | A1 | | 12/2013 | Flusche |
| 2013/0340998 | A1 | | 12/2013 | Flusche |
| 2013/0341036 | A1 | | 12/2013 | Flusche |
| 2014/0041855 | A1 | | 2/2014 | Rodgers |
| 2014/0262518 | A1 | | 9/2014 | Reddy et al. |
| 2014/0262519 | A1 | | 9/2014 | Petrello et al. |
| 2014/0262520 | A1 | | 9/2014 | Petrello et al. |
| 2014/0270974 | A1 | | 9/2014 | Seng et al. |
| 2014/0270975 | A1 | | 9/2014 | Seng et al. |
| 2015/0152690 | A1 | | 6/2015 | Sorokan et al. |
| 2015/0184466 | A1 | | 7/2015 | Rivera, Sr. et al. |
| 2015/0218891 | A1 | | 8/2015 | Padira et al. |

FOREIGN PATENT DOCUMENTS

| | | |
|---|---|---|
| RU | 81516 | 3/2009 |
| RU | 96904 | 8/2010 |
| SU | 1461858 | 2/1989 |
| WO | 2004094762 | 11/2004 |
| WO | 2009002189 | 12/2008 |
| WO | 2010132174 | 11/2010 |

OTHER PUBLICATIONS

Written Opinion for counterpart International Application No. PCT/US2014/037431.

International Search Report and Written Opinion for related PCT Application No. PCT/CA2016/000229 mailed Oct. 26, 2016 (9 pages).

International Search Report and Written Opinion for related PCT Application No. PCT/US2016/019507 dated Dec. 21, 2016 (17 pages).

*Blue Calypso, LLC* v. *Groupon, Inc.* (CAFC, Mar. 1, 2016) (46 pages).

Extended European Search Report for European Patent Application No. 12791970.2, mailed Sep. 2, 2015 (8 pages).

Formal Response to Written Opinion of the International Searching Authority for PCT/CA2012/000510, filed Mar. 14, 2013 (4 pages).

In re Wolfenspérger, 302 F.2d 950 (CCPA 1962), dated May 18, 1962 (8 pages).

International Search Report and Written Opinion for related PCT Application No. PCT/CA2015/000432 mailed Sep. 24, 2015 (9 pages).

National Oilwell Varco Elevator/Substructure/Setback Cross-Section drawing dated Jul. 24, 1979 (1 page).

National Oilwell Varco Mast & Substructure Erection Sequence drawing dated Sep. 15, 1979 (1 page).

Response to Extended European Search Report for EP 12791970.2, filed Mar. 9, 2016 (35 pages).

Written Opinion of the International Searching Authority for PCT Application No. PCT/CA2012/000510, mailed Aug. 24, 2012 (3 pages).

* cited by examiner

DRILLING RIG TRANSFER SYSTEM AND METHOD

CROSS-REFERENCE TO RELATED APPLICATIONS

This application claims the benefit of and priority to U.S. Provisional Patent Application No. 61/821,942, filed May 10, 2013, and U.S. Provisional Patent Application No. 61/872,987, filed Sep. 3, 2013, which are incorporated herein by reference.

DETAILED DESCRIPTION OF THE PREFERRED EMBODIMENTS

Multi-activity arrangements on drilling rigs include two or more rotary tables with a derrick or frame positioned over each rotary table. Alternatively, multi-activity arrangements may include two or more rotary tables with a single derrick or frame positioned over two or more of the rotary tables, with the single derrick or frame having a traveling block positioned over each rotary table. One of the rotary tables may be positioned over the wellbore, while other rotary tables are positioned a distance (e.g., 30 feet) away from the wellbore.

Multi-activity arrangements reduce well construction time by enabling operations to be conducted simultaneously in parallel instead of sequentially. Equipment may be assembled at more than one rotary table simultaneously. At the appropriate time, equipment assembled at a first rotary table must be moved to a second rotary table for use in the wellbore. Where built-in conveyance systems, such as a pipe racking system, are incapable of transferring the equipment due to size or weight of the assembled equipment, a conventional swing transfer method is used.

In the conventional swing transfer method, a first end of slings or bails are attached to a first traveling block suspended from a first derrick positioned over a first rotary table. The second end of the slings or bails are attached to equipment positioned in the first rotary table. This attachment may be accomplished by attaching a lift eye mechanism to the equipment, lowering the first traveling block such that a shackle may be attached to the lower ends of the slings or bails, then attaching the shackle to the lift eye. Alternatively, the slings or bails may be attached to the equipment positioned in the first rotary table by suspending an elevator from the slings or bails, lowering the first traveling block, and attaching the elevator to the equipment.

In the conventional swing transfer method, a second traveling block suspended from a second derrick positioned over a second rotary table is then lowered in order to attach a first end of a second set of bails to the second traveling block. A second end of the second set of bails may be affixed to the equipment positioned in the first rotary table or to a lift device affixed to the equipment. Accordingly, the set of bails is initially horizontally positioned. Both traveling blocks may then be lifted until a lower end of the equipment is removed from the first rotary table. The traveling blocks may then be maneuvered such that the suspended equipment swings to a position above the second rotary table. In other words, the equipment is suspended from the second traveling block, and the second set of bails suspended from the second traveling block are now vertically positioned. The bails or slings attached to the first traveling block are then disconnected from the equipment.

Figure 1:
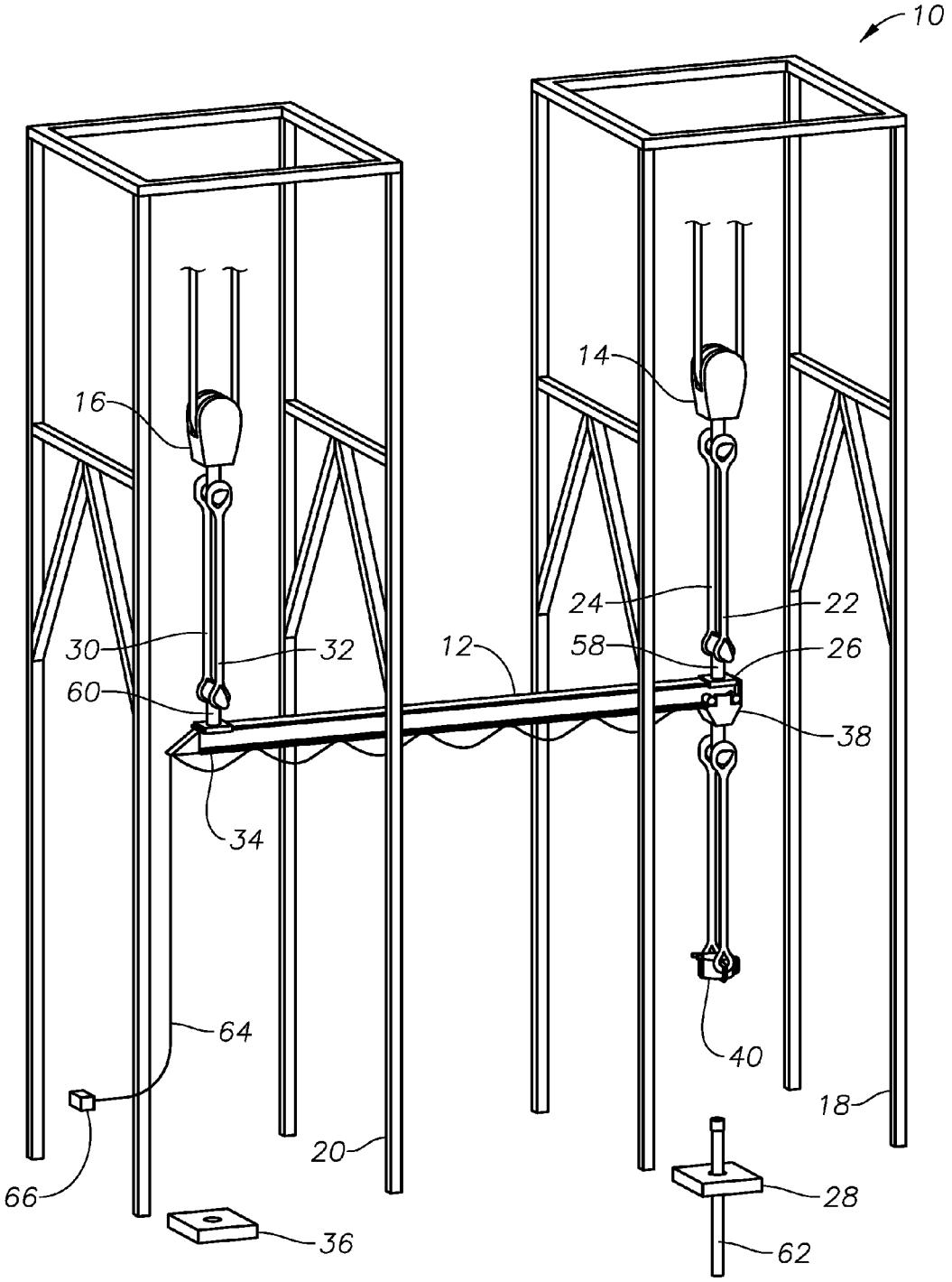
FIG. 1 is a perspective view of a drilling rig transfer system.

FIG. 1 shows drilling rig transfer system 10 including mobile transfer beam 12 suspended from first traveling block 14 and second traveling block 16. First traveling block 14 is suspended from first frame 18, and second traveling block 16 is suspended from second frame 20. Connection lines 22 and 24 may be operatively connected to first traveling block 14 and first suspension position 26 on mobile transfer beam 12 to suspend first suspension position 26 above first location 28. Connection lines 30 and 32 may be operatively connected to second traveling block 16 and second suspension position 34 of mobile transfer beam 12 to suspend second suspension position 34 above second location 36. While FIG. 1 illustrates a first rotary table at first location 28 and a second rotary table at second location 36, drilling rig transfer system 10 may be used with another clamping mechanism (e.g., a rotary table, a false rotary, a work station, a holding station, a rat hole, a mouse hole, slips, or chocks), an opening such as a collar in the drilling rig floor, or simply the drilling rig floor positioned at first location 28 and/or second location 36.

First suspension position 26 may be at a first end of mobile transfer beam 12, and second suspension position 34 may be at a second end of mobile transfer beam 12. Alternatively, if the length of mobile transfer beam 12 is longer than the distance between first location 28 and second location 36, one or both of first and second suspension positions 26 and 34 may be at a point along mobile transfer beam 12 other than its end. Connection lines 22, 24, 30, and 32 may be formed of bails, slings, chains, pup joints, tubular members, or any other suspension lines known in the art.

Drilling rig transfer system 10 further includes trolley assembly 38 and connection mechanism 40. Connection mechanism 40 may include an elevator, a threaded cap with a pad eye, a hydraulic lock clamp, or any other mechanism known in the art for selectively connecting a piece of equipment positioned at first location 28 or second location 36 to trolley assembly 38. Drilling rig transfer system 10 may include two or more trolley assemblies 38, with each trolley assembly 38 being operatively connected to and moveable along mobile transfer beam 12. In this way, drilling rig transfer system 10 may be capable of moving and/or suspending more than one device simultaneously.

Figure 2A:
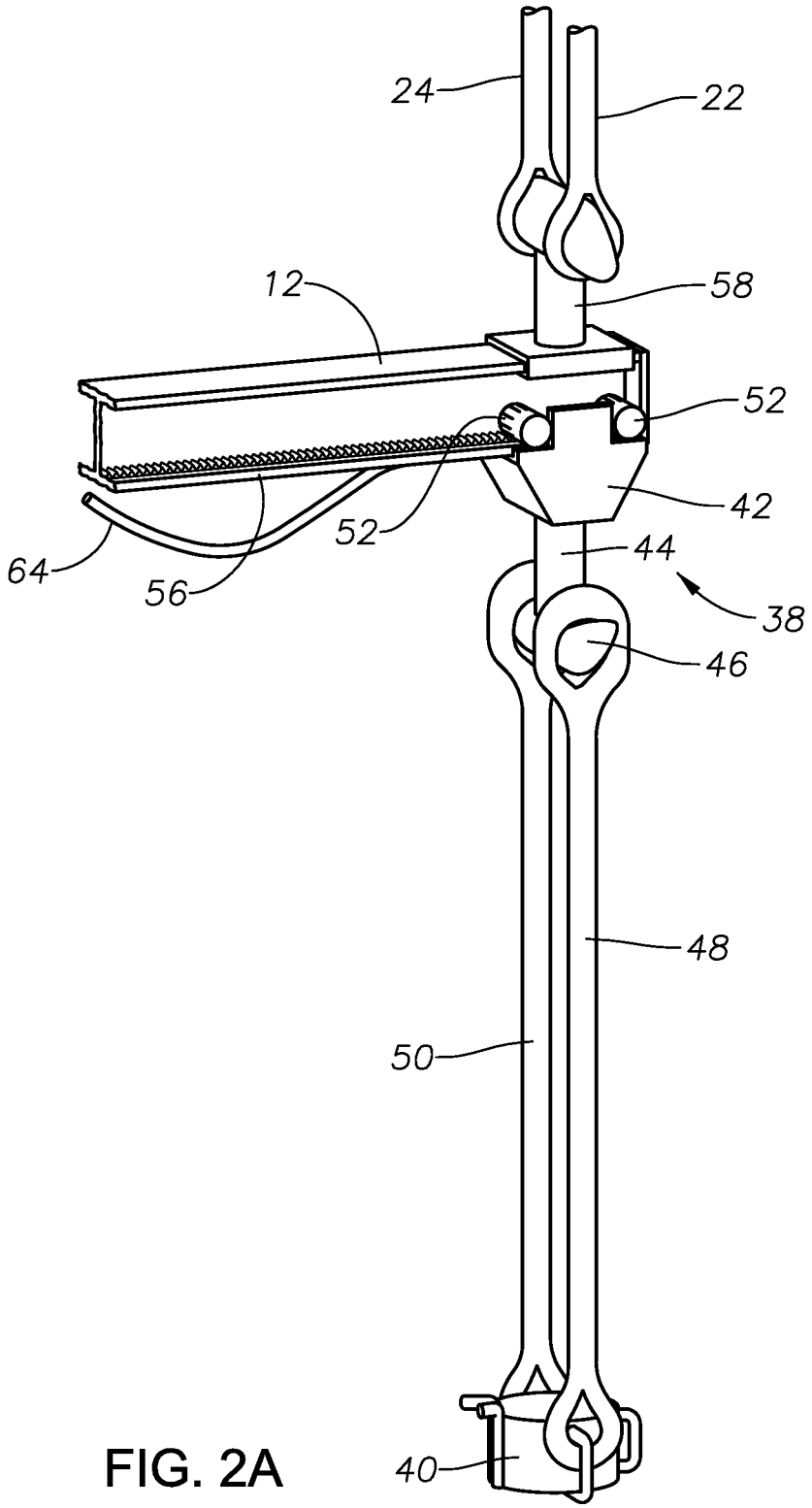
FIG. 2A is a perspective view of a trolley assembly of the drilling rig transfer system.
Figure 2B:
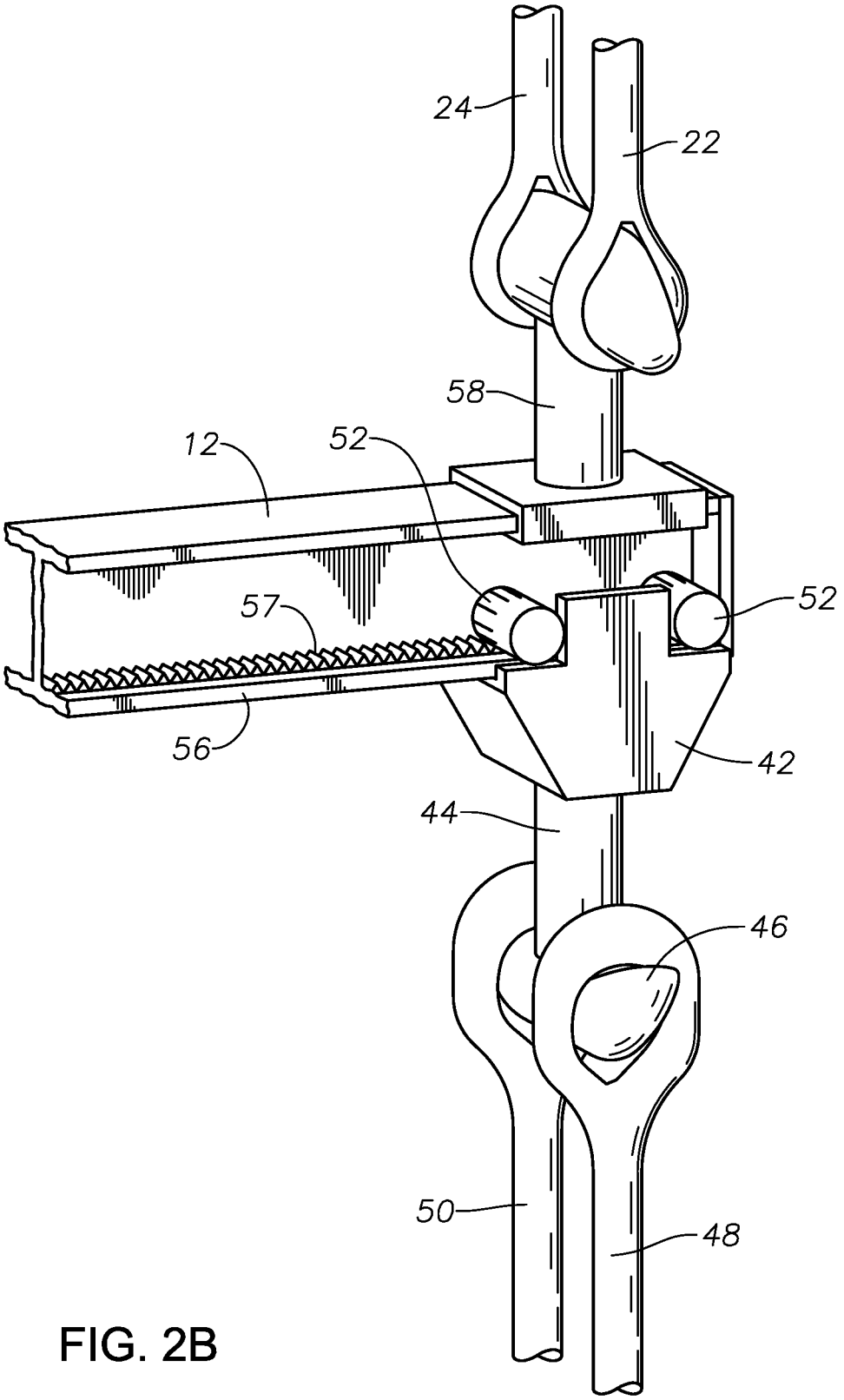
FIG. 2B is a perspective view of a portion of the trolley assembly cut out in FIG. 1.

With reference to FIG. 2, trolley assembly 38 includes base 42 operatively connected to mobile transfer beam 12 and trolley suspension mechanism 44 affixed to base 42, such as at a lower end of base 42 as shown. Base 42 may be movable along mobile transfer beam 12. Trolley suspension mechanism 44 may include upward facing hook 46. In one embodiment, trolley suspension mechanism 44 may include two upward facing hooks 46. Alternatively, base 42 and trolley suspension mechanism 44 may be integrally formed, such as by including one or more upward facing hooks 46 extending horizontally or vertically from base 42. In another alternative embodiment, trolley suspension mechanism 44 may include posts, pad eyes, bail ears, threaded connections, or any other suspension mechanism known in the art for engaging a connection line. In yet another embodiment, trolley suspension mechanism 44 may include a swivel mechanism capable of rotating. The swivel mechanism may include a locking mechanism to rotationally lock the swivel mechanism. Where trolley suspension mechanism 44 includes a swivel mechanism, trolley assembly 38 may include one or two trolley connection lines and connection mechanism 40 may include a padeye.

Trolley connection lines 48 and 50 may be suspended from upward facing hooks 46 of trolley suspension mechanism 44. Connection mechanism 40 may be suspended from trolley connection lines 48 and 50. Trolley connection lines 48 and 50 may each include an upper aperture and a lower aperture as shown for connecting to upward facing hooks 46 and connection mechanism 40. Trolley connection lines 48 and 50 may be formed of bails, slings, chains, pup joints, tubular members, or any other suspension lines known in the art. Alternatively, system 10 may include only one trolley connection line. Drilling rig transfer system 10 may further include a weight measuring mechanism, such as a load cell, to measure the weight or load held by trolley connection lines 48 and 50. The weight measuring mechanism may be affixed to or integrated with trolley suspension mechanism 44. Alternatively, the weight measuring mechanism may be positioned below trolley suspension mechanism 44. The weight measuring mechanism may be electronic, hydraulic, or pneumatic, and may measure the applied load in compression or tension.

Figure 2C:
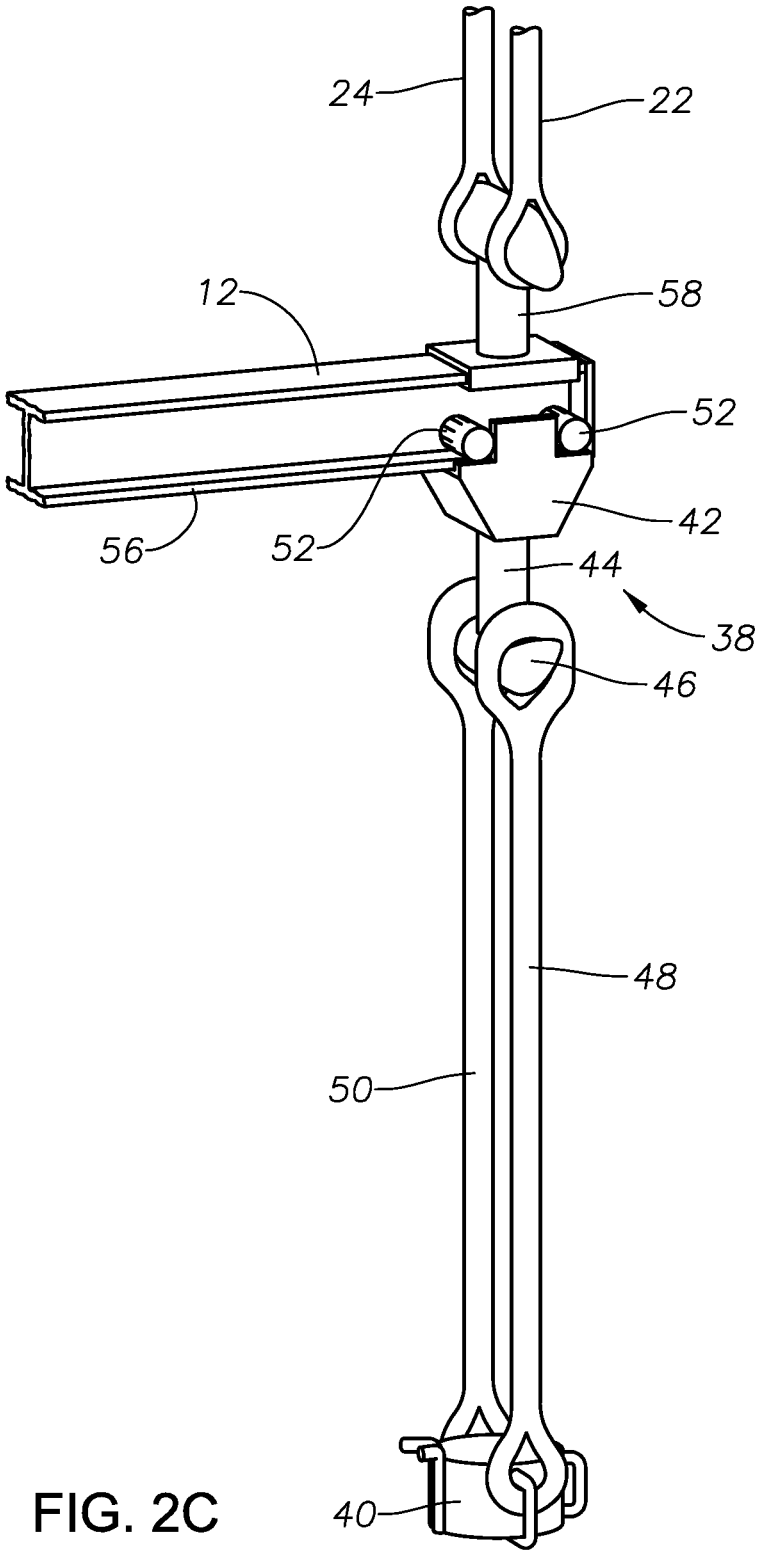
FIG. 2C is a perspective view of a trolley assembly of an alternate embodiment of the drilling rig transfer system.

Trolley assembly 38 may further include rollers 52, which may be operatively connected to base 42 for facilitating the movement of base 42 along mobile transfer beam 12. Trolley assembly 38 may include any number of rollers 52, which may be distributed between the two sides of base 42. For example, trolley assembly 38 may include four rollers 52, with two rollers 52 on the side visible in FIG. 2 and two rollers 52 (not shown) on the opposite side of mobile transfer beam 12. Rollers 52 may be disposed above horizontal extension 56 of mobile transfer beam 12, and may roll along an upper surface of horizontal extension 56. Horizontal extension 56 may include teeth 57 (shown in FIG. 2B) for engaging a gear used to move trolley assembly 38 along mobile transfer beam 12. Mobile transfer beam 12 may be formed of an I-beam, an H-beam, a T-beam, a C-channel, a W-shaped beam, an M-shaped beam, an S-shaped beam, an HP shaped beam, a tubular member, or any other structural beam known in the art. Where mobile transfer beam 12 is formed of a tubular member, bearings that fit around and roll or slide along the tubular member may be included in trolley assembly 38. In another alternate embodiment, trolley assembly 38 may include a worm drive, a rack and pinion drive, a chain drive, a cylinder drive, a winch assembly, a ball screw drive (including a nut and a reciprocating ball), or any other mechanism capable of moving base 42 along mobile transfer beam 12. For example, if a rack and pinion drive is included, a set of teeth (such as teeth 57) may be positioned on an upper surface of horizontal extension 56 of mobile transfer beam 12. FIG. 2C shows an alternate embodiment of trolley assembly 38 having no teeth 57 on horizontal extension 56 of mobile transfer beam 12.

With reference to FIGS. 1 and 2, drilling rig transfer system 10 may include first suspension mechanism 58 operatively connected to first suspension position 26 of mobile transfer beam 12 for selective attachment to connection lines 22 and 24. Drilling rig transfer system 10 may also include second suspension mechanism 60 operatively connected to second suspension position 34 of mobile transfer beam 12 for selective attachment to connection lines 30 and 32. First and second suspension mechanisms 58 and 60 may each be fixed to first and second suspension positions 26 and 34 of mobile transfer beam 12. For example, the connection means by which first and second suspension mechanisms 58 and 60 are connected to first and second suspension positions 26 and 34 of mobile transfer beam 12 may be welding, pin, bolt, screw, bracket, clamp, or any other connection means known in the art. Alternatively, one or both of first and second suspension mechanisms 58 and 60 may be adjustably connected (e.g., by pin, bolt, screw, bracket, clamp, or any other connection means known in the art) to first and second suspension positions 26 and 34 of mobile transfer beam 12 for adjustment of drilling rig transfer system 10 to differing distances between first and second locations 28 and 36 on mobile transfer beam 12. For example, mobile transfer beam 12 may include a plurality of openings positioned along the length of mobile transfer beam 12, and first and/or second suspension mechanisms 58 and 60 may be connected with a bolt, pin, clamp, or other attaching mechanism to different openings depending upon the location of first and/or second locations 28 and 36 on a given drilling rig.

First suspension mechanism 58 and second suspension mechanism 60 may each include one or more downward facing hooks designed to engage an aperture in a lower end of each connection line 22, 24, 30, and 32. Alternatively, first suspension mechanism 58 and second suspension mechanism 60 may each include posts, pad eyes, bail ears, threaded connections, or any other suspension mechanism known in the art for engaging a lower end of each connection line 22, 24, 30, and 32.

Drilling rig transfer system 10 may be connected to existing first and second traveling blocks 14 and 16 on first and second frames 18 and 20 of a drilling rig. Connection lines 22 and 24 may be attached to first traveling block 14, and connection lines 30 and 32 may be attached to second traveling block 16. Mobile transfer beam 12 may then be attached to connection lines 22, 24, 30, and 32 by placing apertures in the lower ends of connection lines 22, 24, 30, and 32 around the downward facing hooks of first suspension mechanism 58 and second suspension mechanism 60. Drilling rig transfer system 10 may include a level indicator affixed to mobile transfer beam 12 to allow a user to evaluate whether mobile transfer beam 12 is positioned horizontally level when suspended from first and second traveling blocks 14 and 16. In one embodiment, mobile transfer beam 12 may be held in a handling cradle to position mobile transfer beam 12 and first and second suspension mechanisms 58 and 60 in an upright position for connection to lower ends of connection lines 22, 24, 30, and 32.

Base 42, rollers 52, and trolley suspension mechanism 44 may be attached to mobile transfer beam 12 before mobile transfer beam 12 is suspended from connection lines 22, 24, 30, and 32. Alternatively, base 42, rollers 52, and trolley suspension mechanism 44 may be attached to mobile transfer beam 12 after it is suspended from connection lines 22, 24, 30, and 32. Trolley connection lines 48 and 50 may then be connected to trolley suspension mechanism 44 by placing an aperture in the upper end of each trolley connection line 48 and 50 around upward facing hooks 46 of trolley suspension mechanism 44. Connection mechanism 40 may then be attached to a lower end of each of trolley connection lines 48 and 50. Connection mechanism 40 may be positioned over first location 28 by moving trolley assembly 38 along mobile transfer beam 12 to first suspension position 26.

Figure 3:
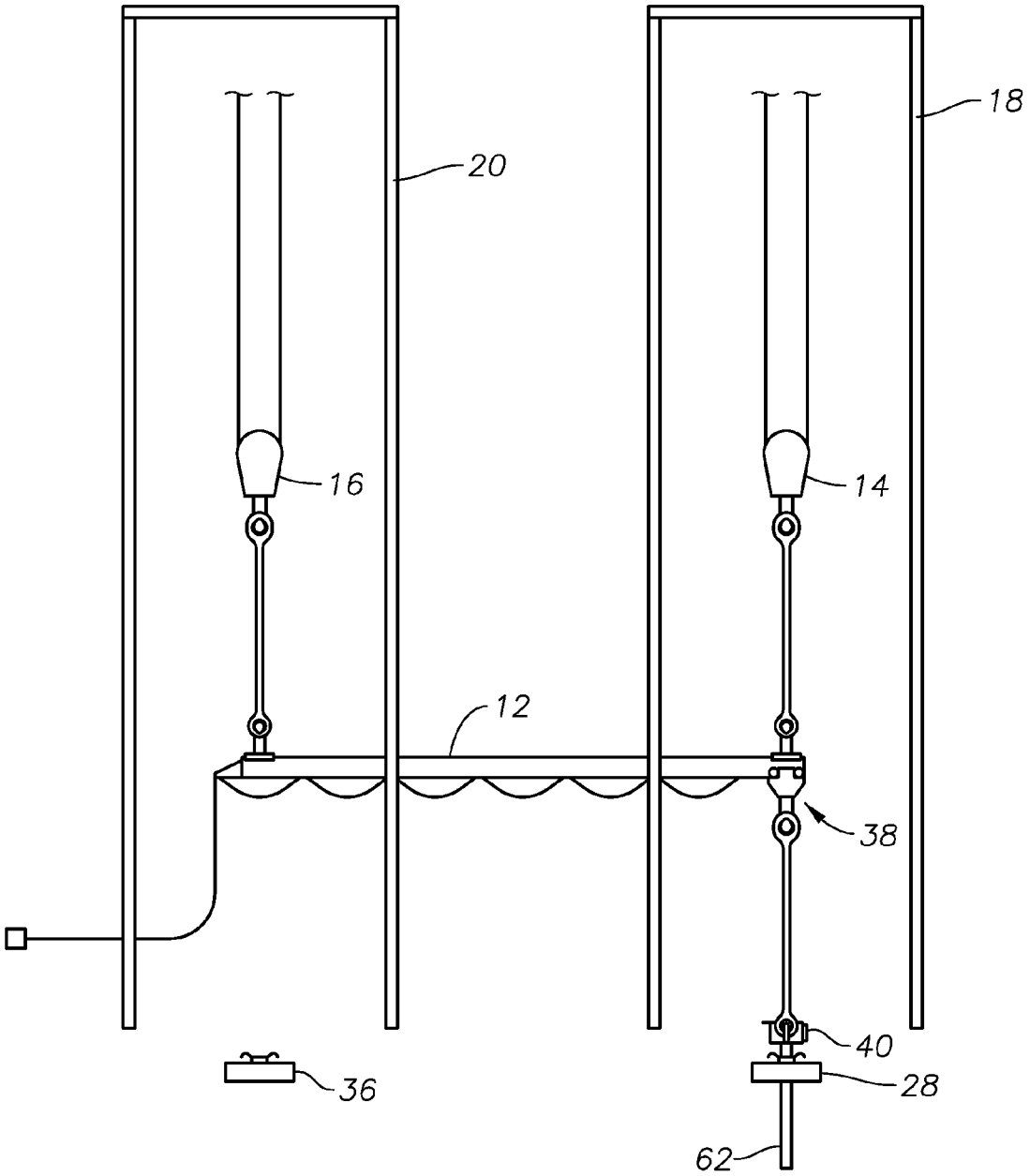
FIG. 3 is a front view of the drilling rig transfer system connected to a device positioned in a first location on a drilling rig.

Referring to FIG. 3, connection mechanism 40 may then be lowered to device 62 positioned at first location 28 (i.e., the first rotary table in FIG. 3) by lowering first traveling block 14 and second traveling block 16. Device 62 may be any assembly or piece of equipment requiring transfer from first location 28 to second location 36. Connection mechanism 40 may be attached to an upper end of device 62. In an alternate embodiment, connection mechanism 40 may first be connected to device 62 and connection mechanism 40 may then be connected to trolley connection lines 48 and 50. For example, this alternate sequence of connection may be used where connection mechanism 40 is a threaded cap with a pad eye, which may be used with a single trolley connection line.

Figure 4:
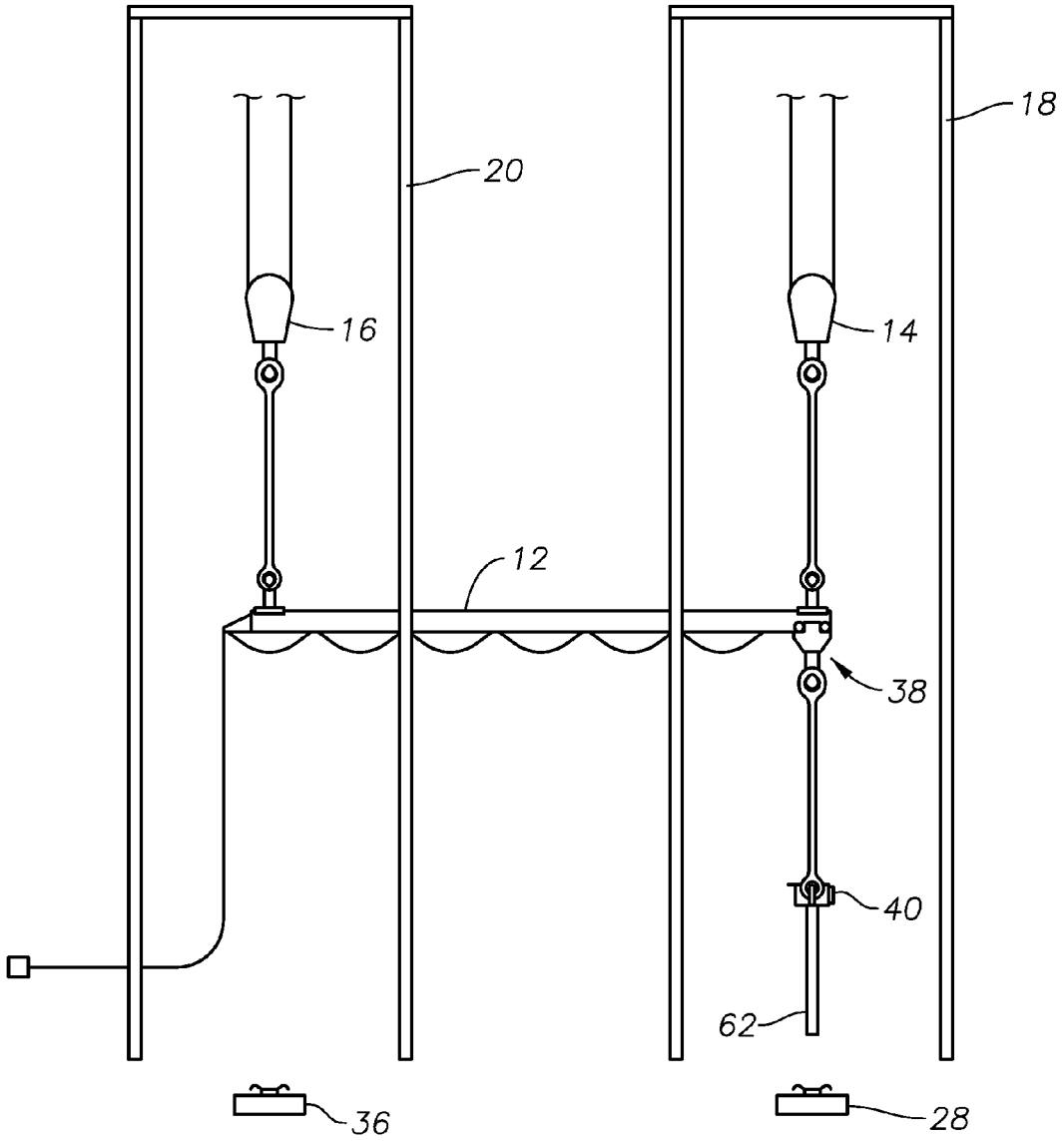
FIG. 4 is a front view of the drilling rig transfer system lifting the device.

With reference to FIG. 4, connection mechanism 40 and device 62 may then be lifted by raising first traveling block 14 and second traveling block 16 until a lower end of device 62 is removed from first location 28 as shown. Where device 62 is positioned in a rotary table, other clamping mechanism, or an opening in the drilling rig at first location 28, device 62 must be lifted to a height sufficient for a lower end of device 62 to clear the rotary table, other clamping mechanism, or the drilling rig floor. It may be necessary to lift connection mechanism 40 and device 62 an additional height above the drilling rig floor to allow the lower end of device 62 to clear any obstruction positioned between first location 28 and second location 36 in subsequent steps. In one embodiment, drilling rig transfer system 10 may include a positioning memory system for locating (by electronic or any other suitable means) and remotely aligning the position of trolley assembly 38 in relation to first and second locations 28 and 36.

Figure 5:
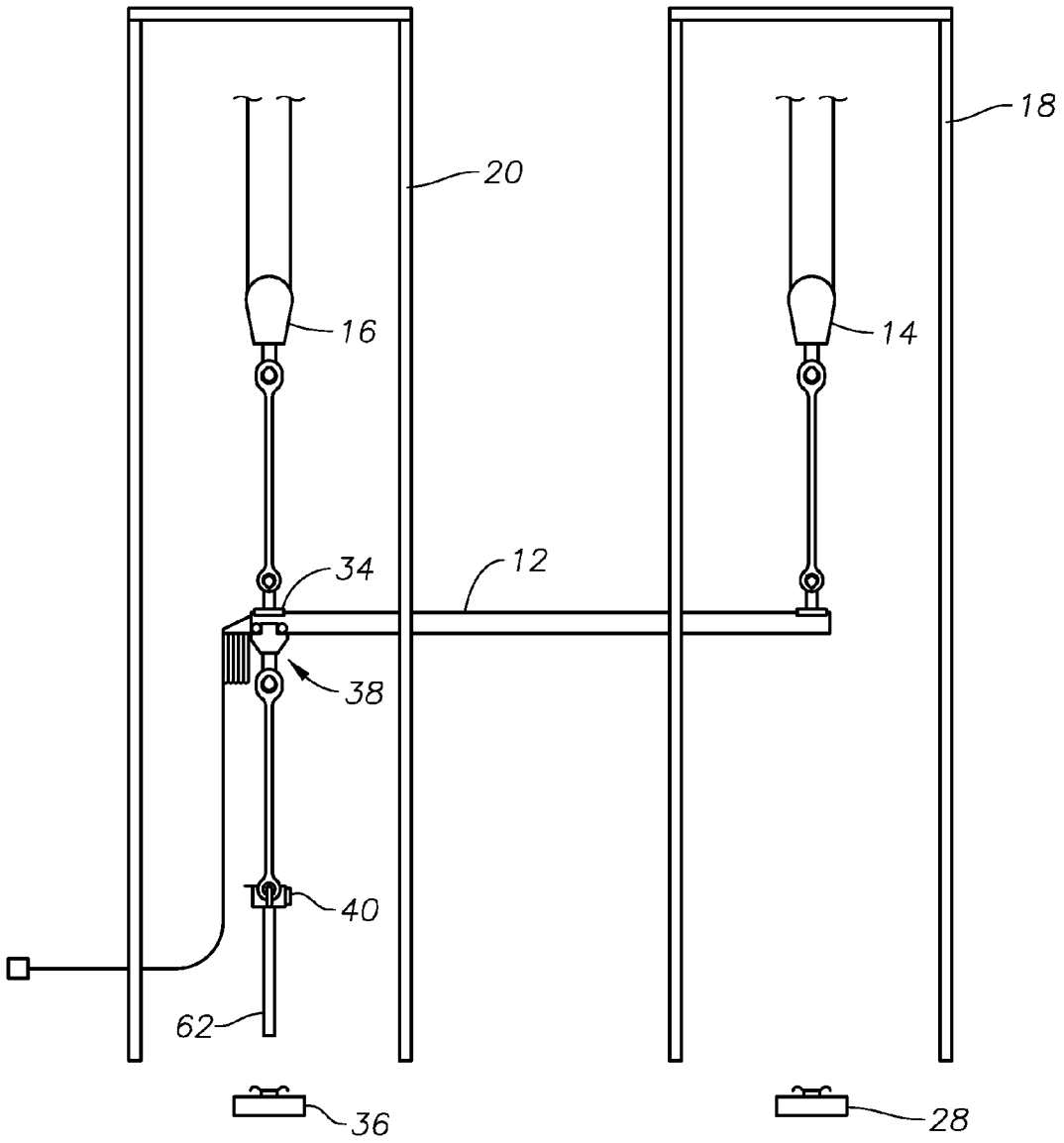
FIG. 5 is a front view of the drilling rig transfer system positioning the device over a second location on a drilling rig.
Figure 6:
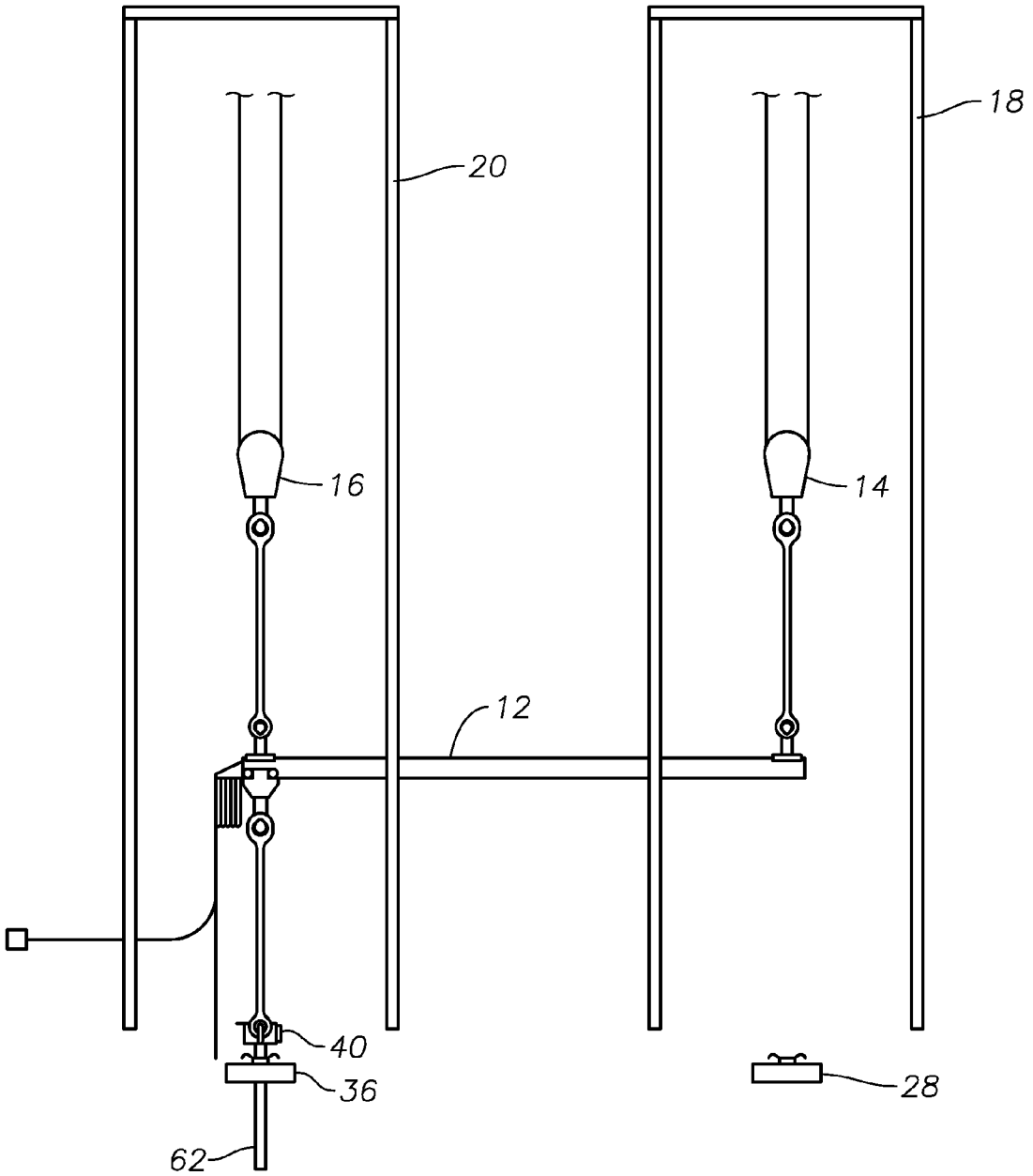
FIG. 6 is a front view of the drilling rig transfer system lowering the device onto the second location.

Connection mechanism 40 and device 62 may be transferred from above first location 28 to a position above second location 36 as shown in FIG. 5 by moving trolley assembly 38 along mobile transfer beam 12 to second suspension position 34. Device 62 may then be lowered into second location 36 as shown in FIG. 6 by lowering first traveling block 14 and second traveling block 16.

Once device 62 is positioned at second location 36, connection mechanism 40 may be disconnected from device 62 and supported at second location 36. Drilling rig transfer system 10 may then be removed by disconnecting connection mechanism 40 from the lower end of trolley connection lines 48 and 50. Alternatively, connection mechanism 40 may first be disconnected from the lower end of trolley connection lines 48 and 50, before connection mechanism 40 is disconnected from device 62.

Trolley connection lines 48 and 50 may be removed from trolley suspension mechanism 44 by releasing the upper ends of trolley connection lines 48 and 50 from upward facing hooks 46. Mobile transfer beam 12 may be disconnected from connection lines 22, 24, 30, and 32 by removing the apertures at the bottom of connection lines 22, 24, 30, and 32 from the downward facing hooks of first suspension mechanism 58 and second suspension mechanism 60. Alternatively, base 42, rollers 52, and trolley suspension mechanism 44 may be removed from mobile transfer beam 12 before mobile transfer beam 12 is disconnected from connection lines 22, 24, 30, and 32. Connection lines 22, 24, 30, and 32 may remain attached to or be removed from first traveling block 14 and second traveling block 16, depending upon the next intended use of first traveling block 14 and second traveling block 16.

Trolley assembly 38 may include a power system, such as a hydraulic power system, a pneumatic power system, electric power system, any other system for providing power that is known in the art, or any combination of these power systems for moving trolley assembly 38 along mobile transfer beam 12. For example, FIG. 1 shows a hydraulic power system for trolley assembly 38 including hydraulic line 64 and control box 66 for moving trolley assembly 38 along mobile transfer beam 12. The hydraulic power system may further include a hydraulic motor, which may be affixed to base 42, affixed to an end of mobile transfer beam 12, or positioned in any other suitable location on or near drilling rig transfer system 10.

Trolley assembly 38 may also include a braking system, such that trolley assembly 38 will not move along mobile transfer beam 12 due to drilling rig movement or due to first and second traveling blocks 14 and 16 becoming horizontally unaligned for any reason that causes mobile transfer beam 12 to tilt. The braking system may selectively prevent movement of trolley assembly 38 along mobile transfer beam 12 even when device 62 is suspended from connection mechanism 40. The braking system may be a fail-safe brake that fails to a braked position (i.e., power must be applied to the braking system in order to allow movement of trolley assembly 38 along mobile transfer beam 12). Alternatively, the braking system may include an active brake activated and controlled by an operator. The brakes may be magnetically powered, electrically powered, hydraulically powered, pneumatically powered, spring powered, or powered by any other suitable mechanism known in the art. The braking system may be incorporated into the power system. Trolley assembly 38 may further include a speed-limiting system for controlling the speed at which trolley assembly 38 is moved along mobile transfer beam 12.

In an alternate embodiment, a lifting assembly may be included in or suspended from trolley assembly 38 such that connection mechanism 40 and device 62 may be lifted and lowered without lifting and lowering mobile transfer beam 12 and first and second traveling blocks 14 and 16. Alternatively, mobile transfer beam 12 may be lifted and lowered by the lifting assembly and the first and second traveling blocks 14 and 16. The lifting assembly may be a winch assembly, a hydraulic cylinder assembly, a pneumatic cylinder assembly (e.g., the DIME™ system offered by Devin International), or any other suitable lifting assembly known in the art. Drilling rig transfer system 10 may further include a compensation system, (e.g., the DIME™ compensation system offered by Devin International or any other compensation system known in the art) to compensate for the movement of the drilling rig. The compensation system may be included in or suspended from trolley assembly 38.

In this way, drilling rig transfer system 10 may be used to transfer device 62 from first location 28 to second location 36. For example, drilling rig transfer system 10 may be used to transfer device 62 from one rotary table to another rotary table on a multi-activity drilling rig, where one of the rotary tables may be positioned over a wellbore. Alternatively, drilling rig transfer system 10 may be used to transfer any equipment held in any clamping or holding mechanism, such as a rotary table, a false rotary, a work station, a holding station, a rat hole, a mouse hole, slips, or chocks, on a drilling rig to another clamping or holding mechanism. In another alternative, drilling rig transfer system 10 may be used to transfer any equipment held in any opening in the drilling rig floor for tool make-up purposes to another position on the drilling rig. In yet another alternate embodiment, drilling rig transfer system 10 may be used to transfer any equipment positioned at a first position on the surface of the drilling rig floor to a second position on the surface of the drilling rig in line with mobile transfer beam 12.

Drilling rig transfer system 10 requires less time to transfer equipment between positions on a multi-activity drilling rig than conventional swing transfer systems and methods. The time reduction leads to large decreases in costs in the oil and gas drilling industry in which operators pay large equipment rental fees and labor costs daily. Drilling rig transfer system 10 is also safer and more controlled than conventional swing transfer systems and methods leading to lower likelihood of worker injury or equipment damage.

Drilling rig transfer system 10 may allow operators to transfer a device or assembly that may not be capable of being transferred by built-in transfer systems due to a size or weight of the device or assembly. Because of its mobility, drilling rig transfer system 10 may be temporarily rigged up on a drilling rig for transferring the device or assembly, and it may be rigged down and removed from the area to allow space for other operations. For example, drilling rig transfer system 10 may be attached to existing traveling blocks on a drilling rig to position mobile transfer beam 12 directly above with two or more rotary tables, clamping mechanisms, or drilling rig floor openings to allow for transfer of the device or assembly.

Figure 7:
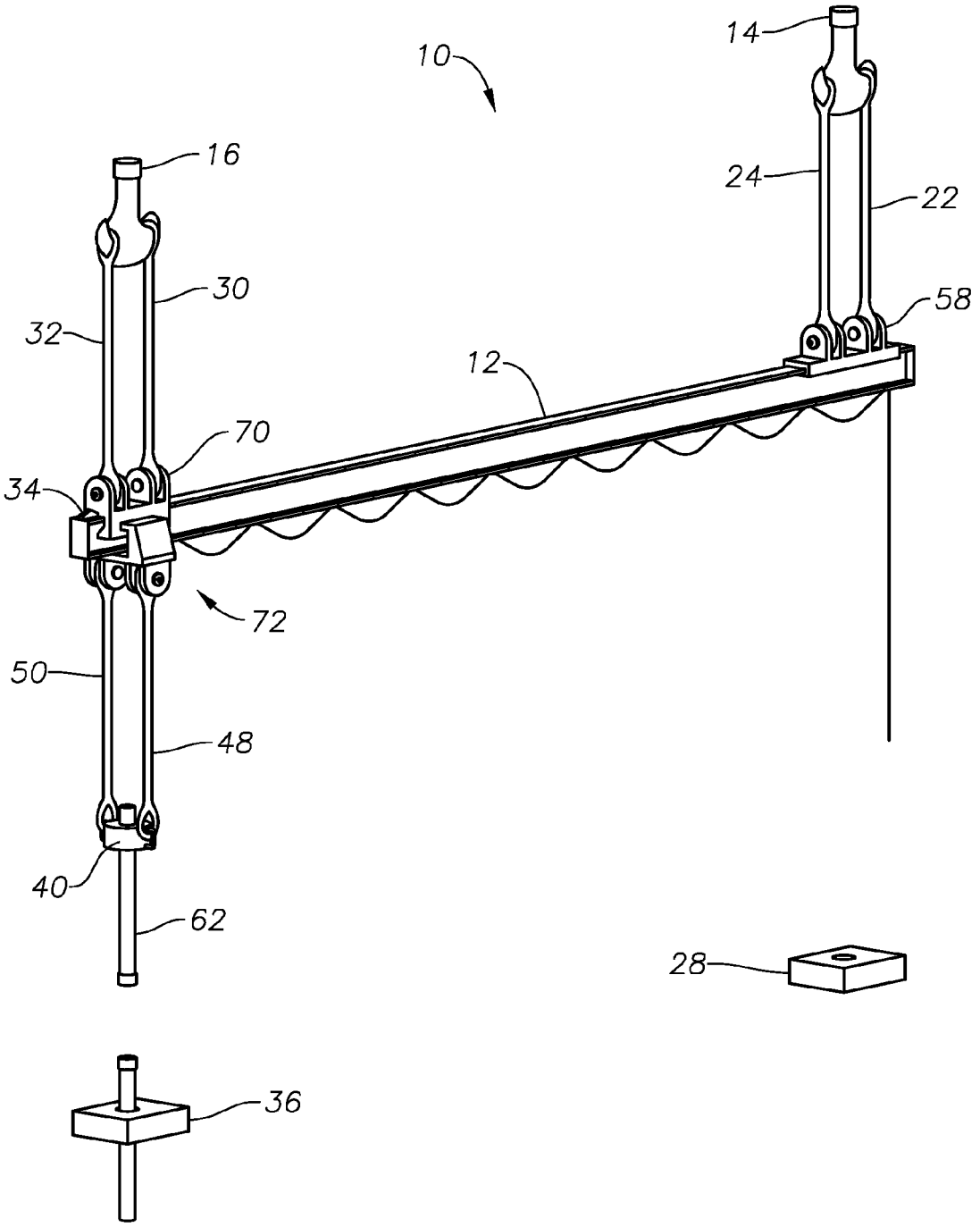
FIG. 7 is a perspective view of an alternate embodiment of the drilling rig transfer system.
Figure 8:
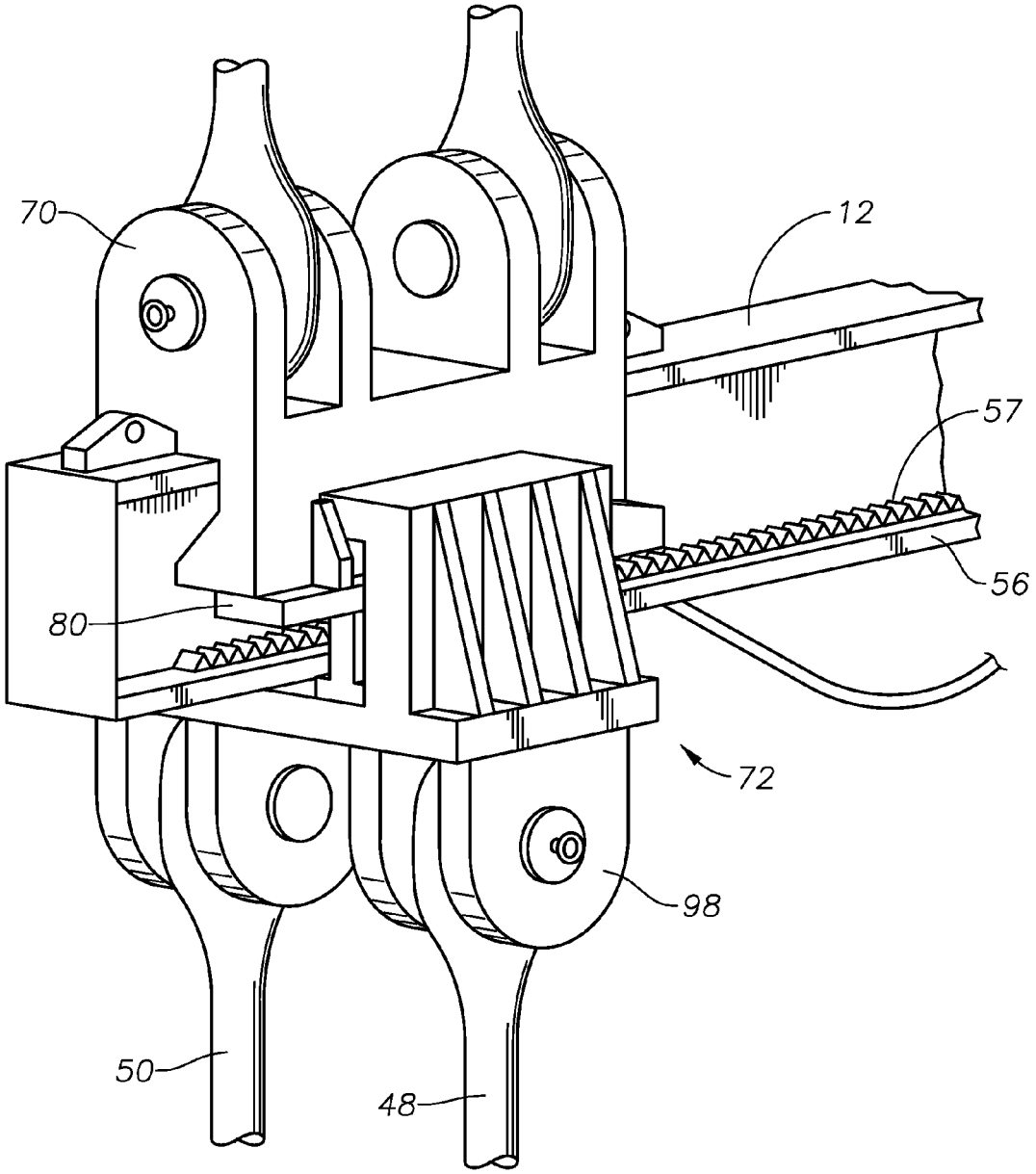
FIG. 8 is a perspective view of a trolley assembly and a suspension mechanism of the drilling rig transfer system of FIG. 7.
Figure 9:
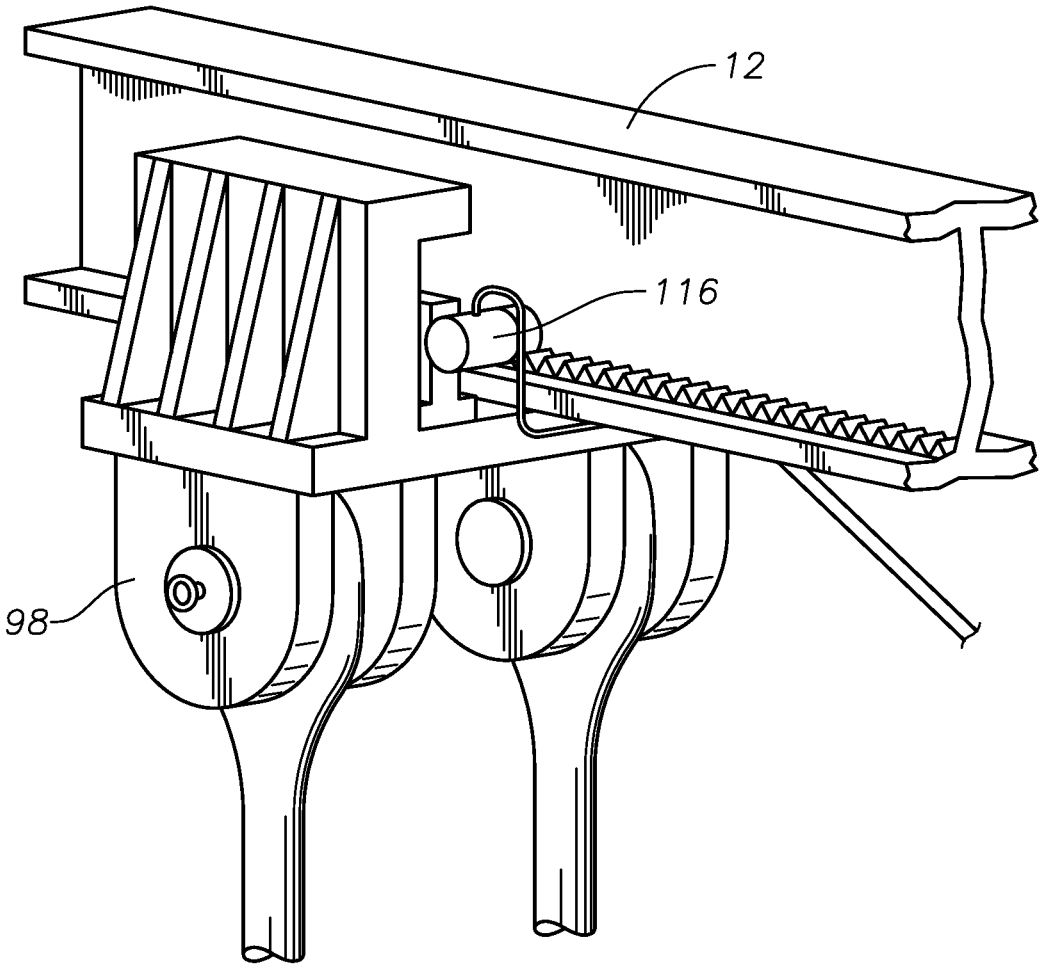
FIG. 9 is a perspective view of the trolley assembly of the drilling rig transfer system of FIG. 7.
Figure 10:
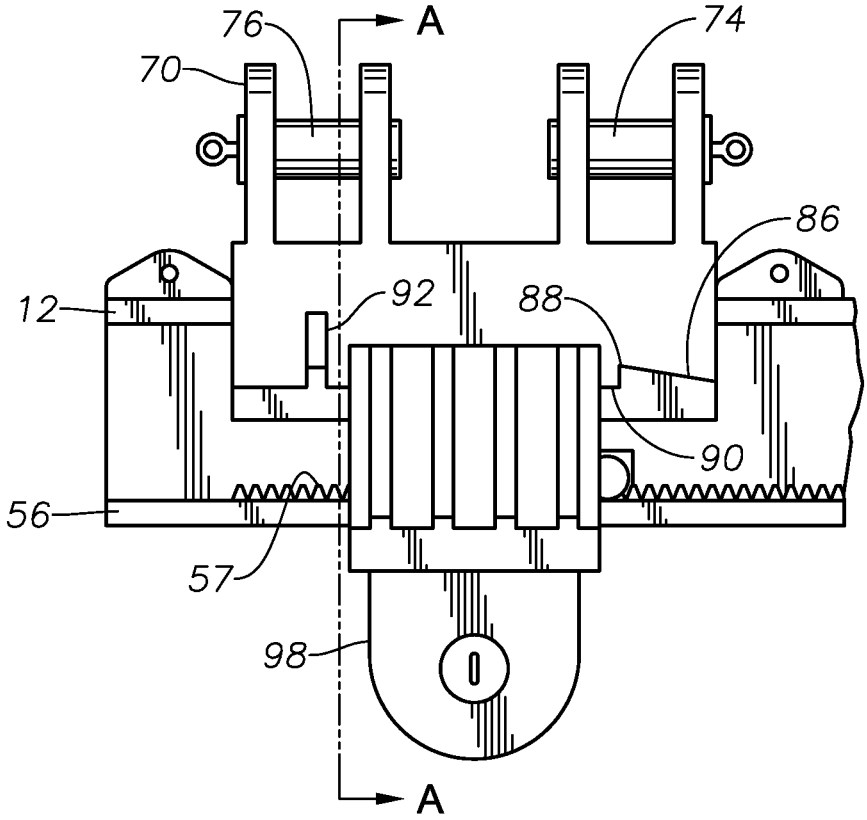
FIG. 10 is a front view of the trolley assembly and the suspension mechanism of the drilling rig transfer system of FIG. 7.
Figure 11:
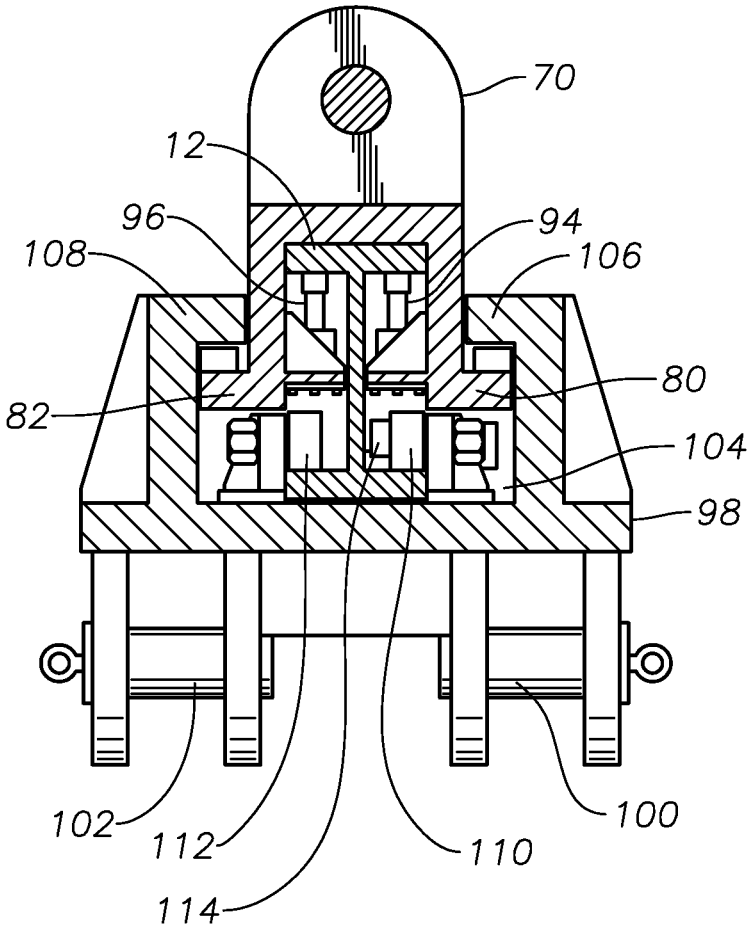
FIG. 11 is a cross-sectional view of the trolley assembly and the suspension mechanism of the drilling rig transfer system of FIG. 7.
Figure 12:
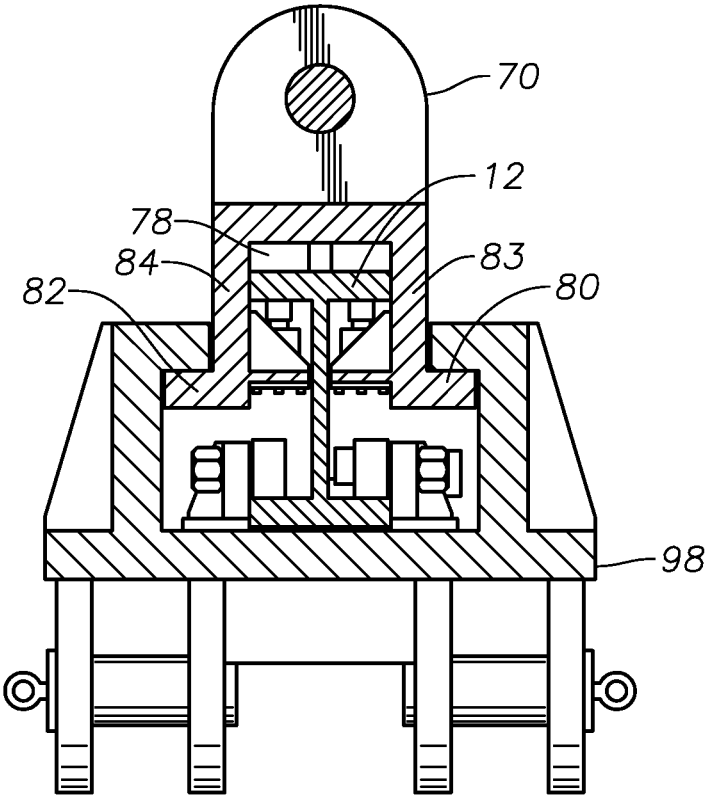
FIG. 12 is another cross-sectional view of the trolley assembly and the suspension mechanism of the drilling rig transfer system of FIG. 7.

FIG. 7 illustrates an alternate embodiment of drilling rig transfer system 10 having alternate second suspension mechanism 70 and alternate trolley assembly 72. FIGS. 8-12 show second suspension mechanism 70 and trolley assembly 72 operatively connected to mobile transfer beam 12. Second suspension mechanism 70 may be disposed over an upper end of mobile transfer beam 12. Second suspension mechanism 70 may include pins 74 and 76 for engaging the lower ends of connection lines 30 and 32. As shown in FIGS. 11 and 12, mobile transfer beam 12 may be disposed through cavity 78 of second suspension mechanism 70. A lower portion of second suspension mechanism 70 may include horizontal extensions 80 and 82 on each side of mobile transfer beam 12. Extensions 80 and 82 may be positioned at the bottom of vertical members 83 and 84 of second suspension mechanism 70, respectively. One or both of extensions 80, 82 may include one or more locking mechanisms, such as the locking mechanism shown in FIG. 10 defined by sloped section 86 leading to shoulder 88 and lower section 90 extending from shoulder 88 to stop 92. Second suspension mechanism 70 may be operatively connected to mobile transfer beam 12 through one or more compression mechanisms, such as hydraulic cylinders 94, 96. It is to be understood that a suspension mechanism of the type of suspension mechanism 70 may be used for one or both of first and second suspension mechanisms. Compression mechanism(s) may include any type of spring, Belleville washer, hydraulic or pneumatic cylinders, accumulator, shock absorbing mechanism, or other compression mechanisms known in the art.

The operative connection of second suspension mechanism 70 to mobile transfer beam 12 may also prevent movement of second suspension mechanism 70 along mobile transfer beam 12. For example, second suspension mechanism 70 may be connected to mobile transfer beam 12 by welding, pin, bolt, screw, bracket, clamp, or any other connection means known in the art. Alternatively, second suspension mechanism 70 may be adjustably connected (e.g., by pin, bolt, screw, bracket, clamp, or any other connection means known in the art) to second suspension position 34 of mobile transfer beam 12 for adjustment of drilling rig transfer system 10 to differing distances between first and second locations 28 and 36 on mobile transfer beam 12. For example, mobile transfer beam 12 may include a plurality of openings positioned along the length of mobile transfer beam 12, and second suspension mechanism 70 may be connected with a bolt, pin, clamp, or other attaching mechanism to different openings depending upon the location of second location 36 on a given drilling rig.

With reference still to FIGS. 8-12, trolley assembly 72 may include base 98 and pins 100 and 102 for engaging the upper ends of trolley connection lines 48 and 50. Base 98 may include cavity 104 and upper extensions 106 and 108. A lower portion of mobile transfer beam 12 may be disposed through cavity 104. Trolley assembly 72 may further include rollers 110, 112, pinion gear 114, and hydraulic motor 116 for allowing movement of trolley assembly 72 along horizontal extension 56 and teeth 57 of mobile transfer beam 12. As trolley assembly 72 is transferred along mobile transfer beam 12 to second suspension position 34, upper extensions 106 and 108 of base 98 may slide over extensions 80 and 82 of second suspension mechanism 70 such that extensions 80 and 82 of second suspension mechanism 70 are disposed through cavity 104 of base 98. Specifically, upper extensions 106 and 108 of base 98 may be disposed above lower section 90 of the locking mechanism. Stop 92 of the locking mechanism may prevent base 98 and trolley assembly 72 from being transferred beyond second suspension position 34 on mobile transfer beam 12.

With trolley assembly 72 positioned at second suspension position 34 on mobile transfer beam 12, hydraulic pressure may be released from cylinders 94, 96. When second traveling block 16 lifts a load that exceed the load of compression mechanism, trolley assembly 72 may be moved from a transfer position shown in FIG. 11 to a locked position shown in FIG. 12. Drilling rig transfer system 10 may be manipulated for use with different equipment on different drilling rigs by using compression mechanisms (e.g., spring, Belleville washer, hydraulic or pneumatic cylinders, accumulator, shock absorbing mechanism, or other compression mechanisms known in the art) having different loads. In the locked position, upper extensions 106 and 108 of base 98 may engage extensions 80 and 82 of second suspension mechanism 70. More specifically, upper extensions 106 and 108 may engage lower section 90 of the locking mechanism on extensions 80 and 82 of second suspension mechanism 70. In this position, the locking mechanism may prevent trolley assembly 72 from moving beyond shoulder 88 and stop 92. In this way, the load path may be changed. Instead of the load being transferred through base 98 to mobile transfer beam 12, then to second suspension mechanism 70, the load in this configuration is transferred through base 98 directly to second suspension mechanism 70. In other words, the load path in the locked position bypasses mobile transfer beam 12.

Figure 13:
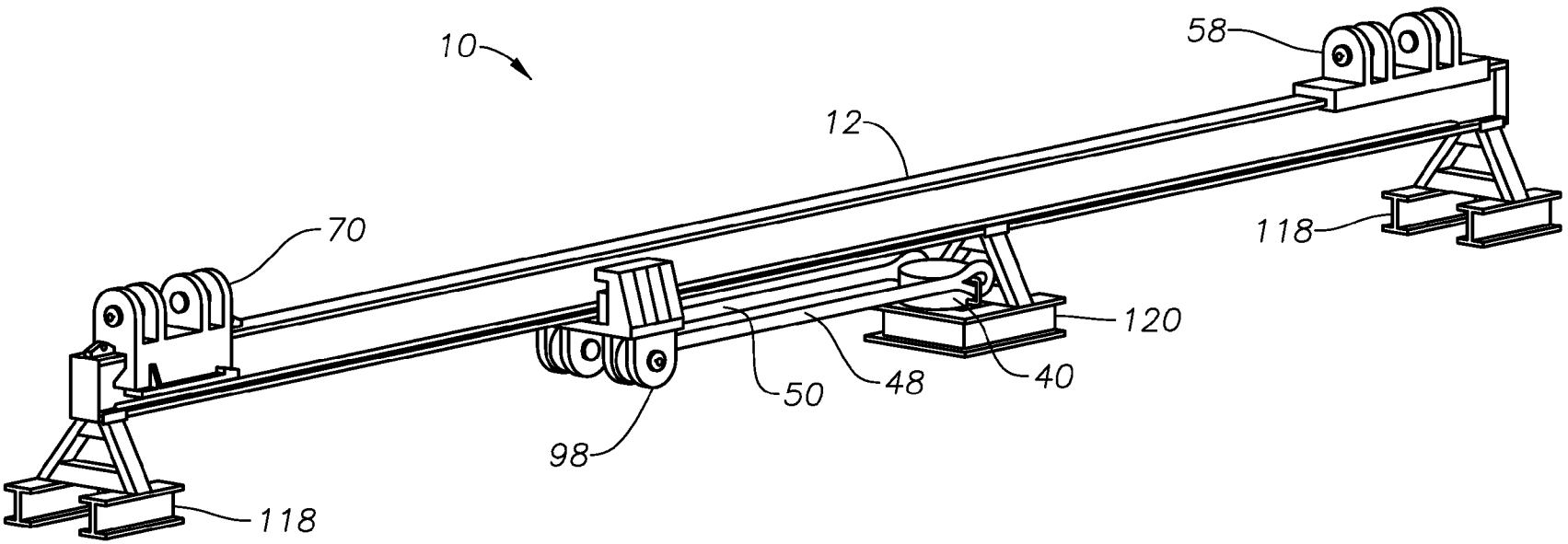
FIG. 13 is a perspective view of the drilling rig transfer system in a travel configuration.
Figure 14:
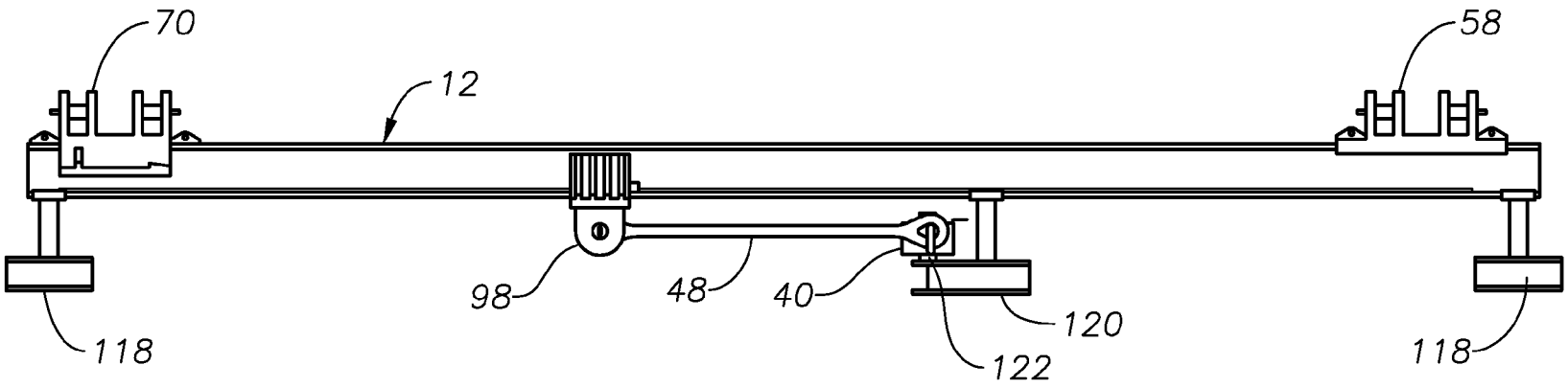
FIG. 14 is a front view of the drilling rig transfer system in a travel configuration.

FIGS. 13 and 14 show drilling rig transfer system 10 in a travel configuration. Legs 118 may be attached to each end of mobile transfer beam 12. Platform 120 may be attached to another area of mobile transfer beam 12. Platform 120 may but is not required to act as another leg for supporting mobile transfer beam 12. Trolley connection lines 48, 50 may be arranged such that connection mechanism 40 is secured on platform 120 as shown. Connection mechanism 40 may be secured to receptacle 122 protruding upward from platform 120. Alternatively, connection mechanism 40 may be secured to platform 120 and/or mobile transfer beam 12 in any suitable manner known in the art. Legs 118 may support mobile transfer beam in an upright position on the ground. Drilling rig transfer system 10 may be placed in the travel configuration for shipment to and from a drilling rig.

FIGS. 15-20 illustrate the method of using the alternate embodiment of drilling rig transfer system 10. If drilling rig transfer system 10 is shipped in the travel configuration, connection mechanism 40 may first be disengaged from receptacle 122 on platform 120, then connection mechanism 40 and trolley connection lines 48, 50 may be arranged into the vertical position shown in FIG. 15. Legs 118 and platform 120 may be removed from mobile transfer beam 12 before use.

Figure 15:
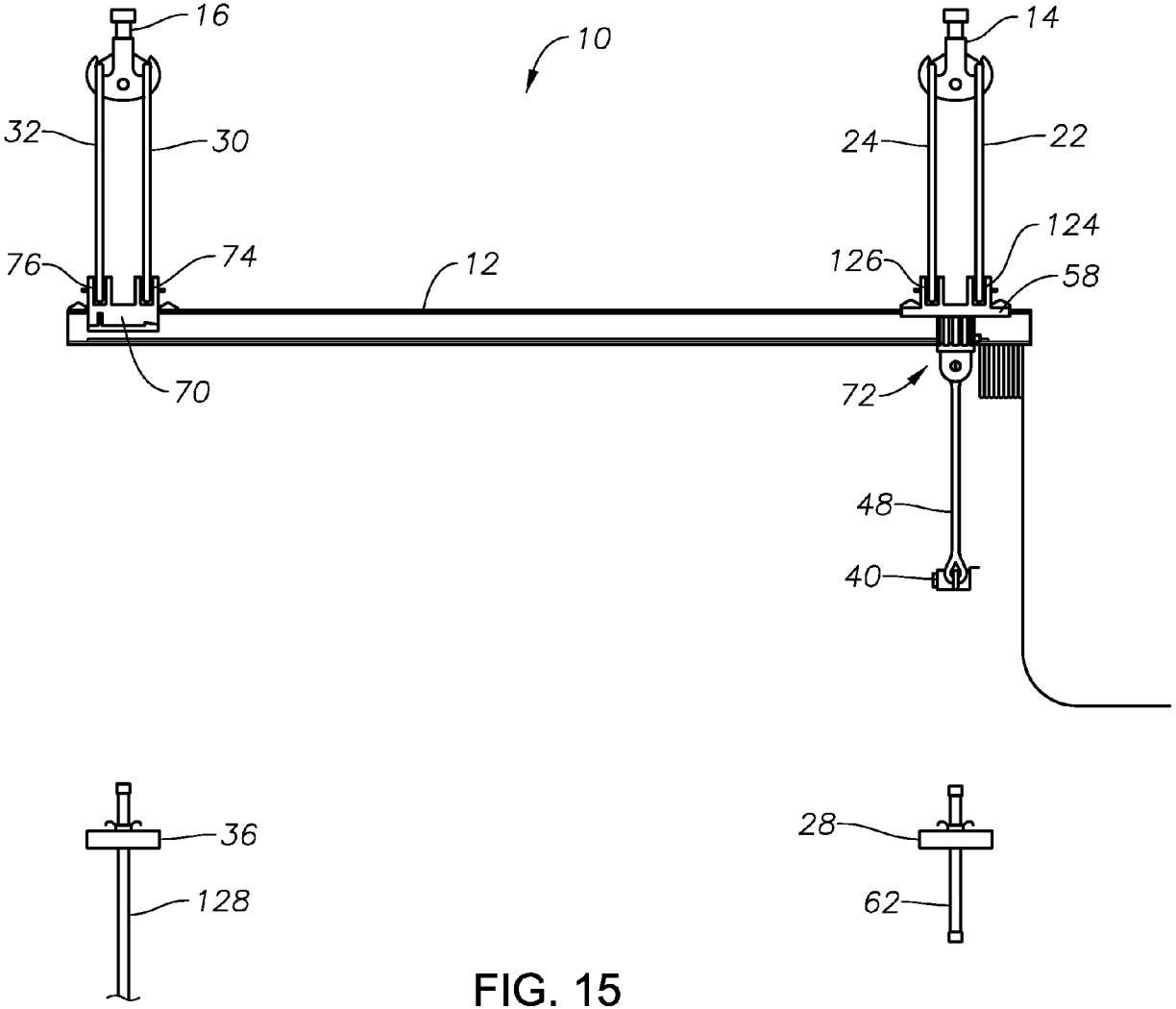
FIG. 15 is a front view of the drilling rig transfer system of FIG. 7.
Figure 16:
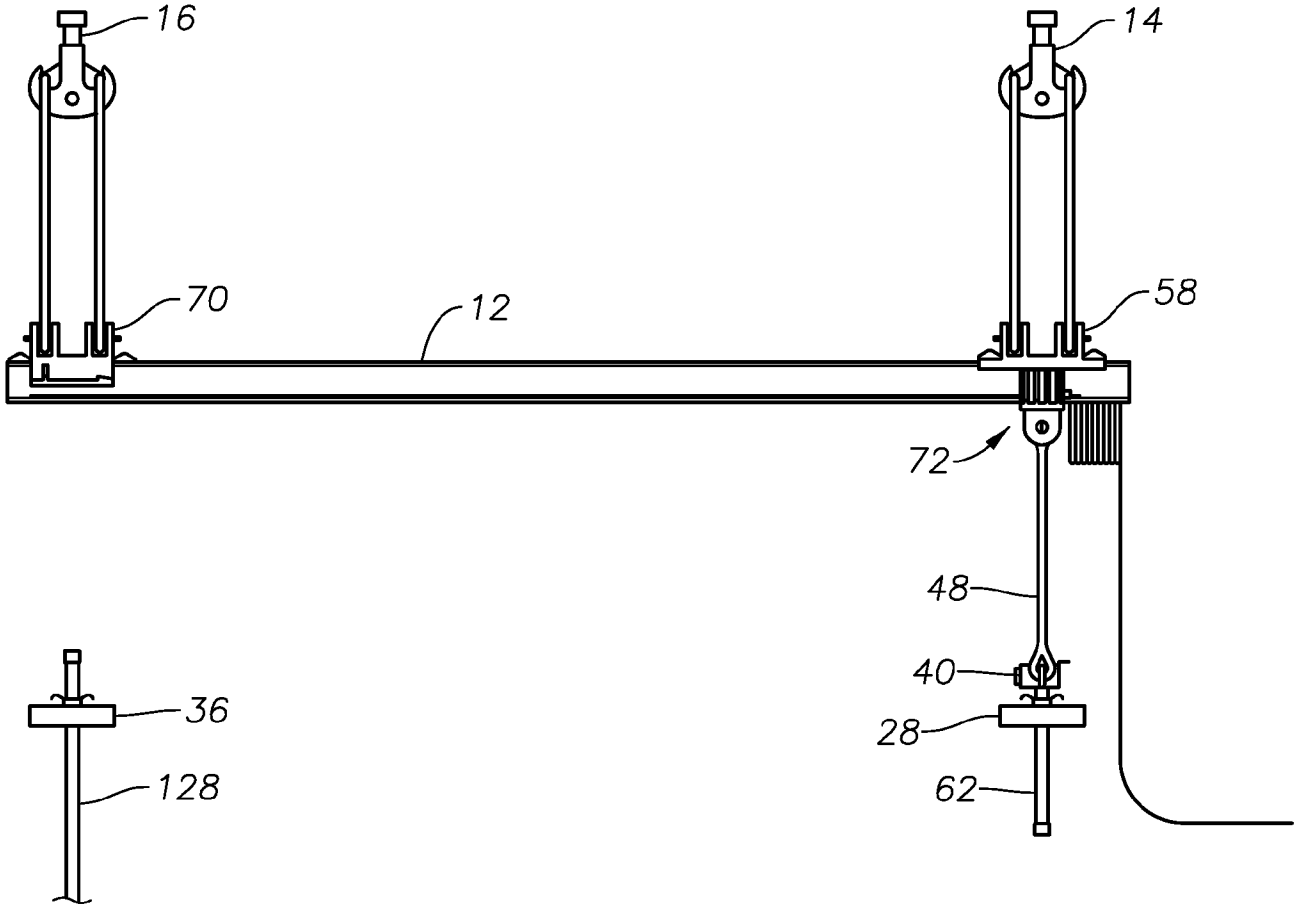
FIG. 16 is a front view of the drilling rig transfer system of FIG. 7 connected to a device positioned in a first location on a drilling rig.

As shown in FIG. 15, connection lines 22, 24, 30, and 32 may be attached to mobile transfer beam 12 by securing pins 124, 126 of first suspension mechanism 58 and pins 74, 76 of second suspension mechanism 70 through the apertures in the lower ends of connection lines 22, 24, 30, and 32, respectively. Connection mechanism 40 and trolley assembly 72 may be positioned above first location 28. Connection mechanism 40 may then be lowered to device 62 positioned at first location 28 by lowering first traveling block 14 and second traveling block 16 to the position shown in FIG. 16. Device 62 may be any assembly or piece of equipment requiring transfer from first location 28 to second location 36. For example, device 62 may be a subsea test tree or a landing string module. Connection mechanism 40 may be attached to an upper end of device 62 as shown in FIG. 16.

Figure 17:
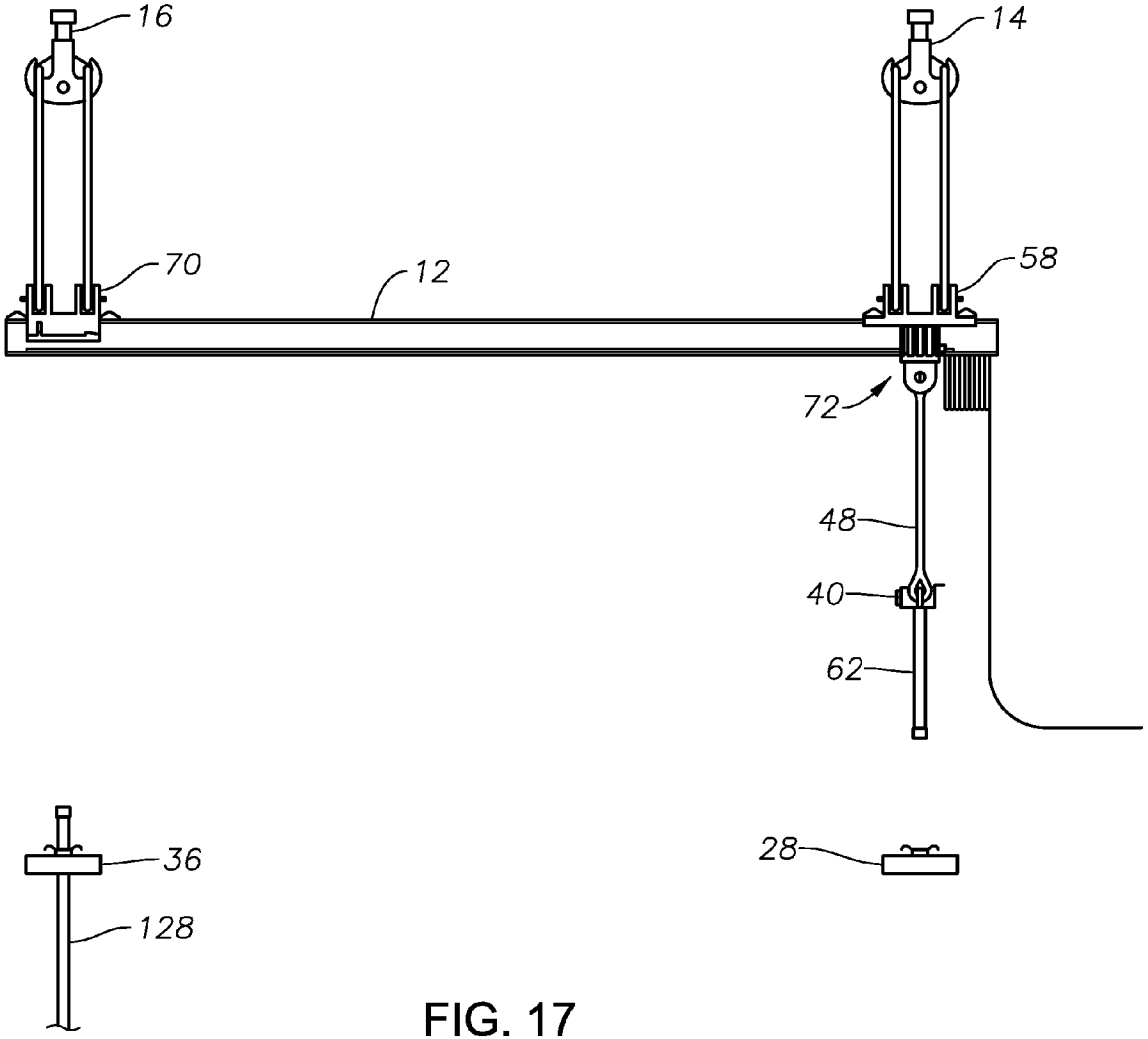
FIG. 17 is a front view of the drilling rig transfer system of FIG. 7 lifting the device.
Figure 18:
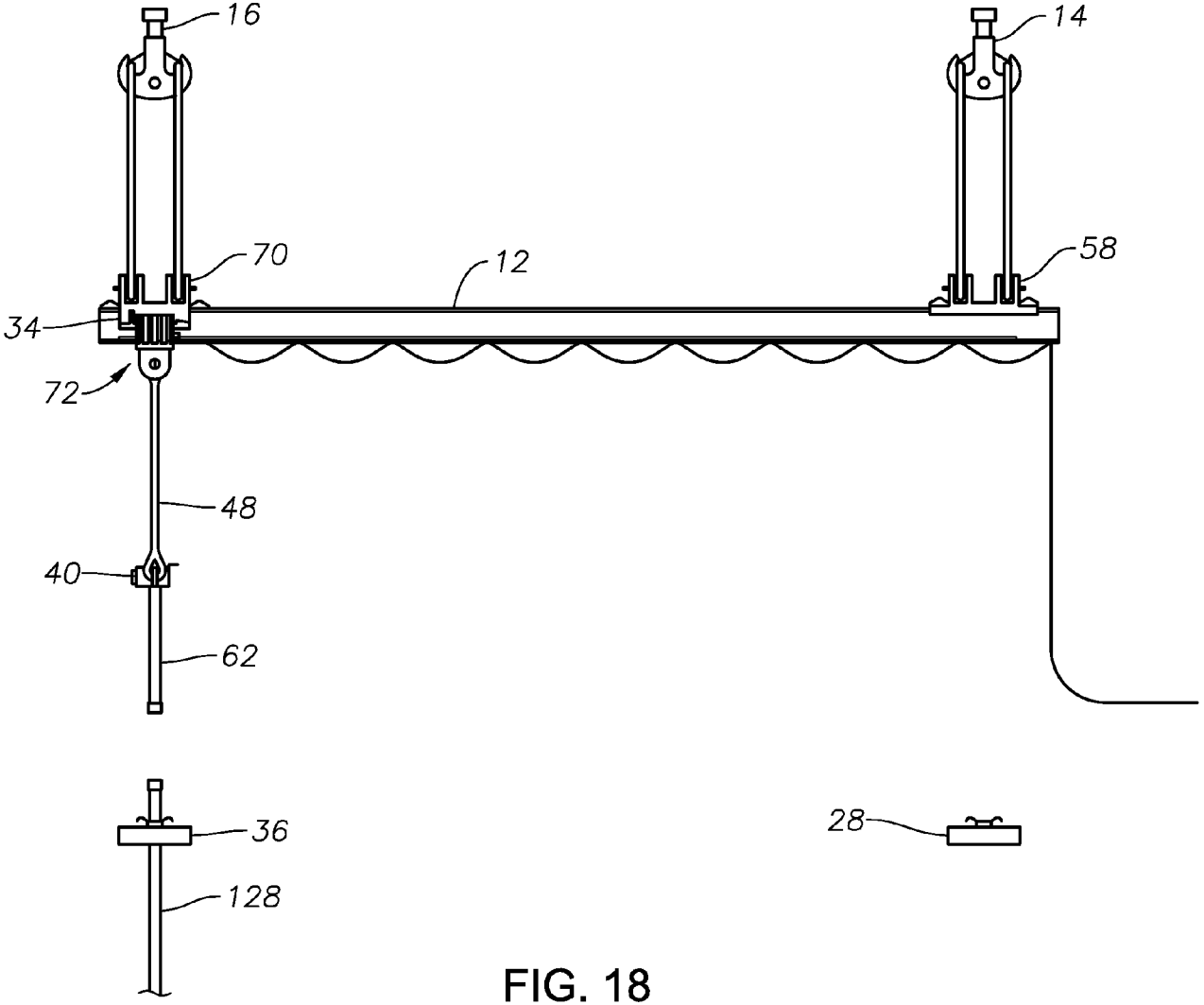
FIG. 18 is a front view of the drilling rig transfer system of FIG. 7 positioning the device over a second location on a drilling rig.
Figure 19:
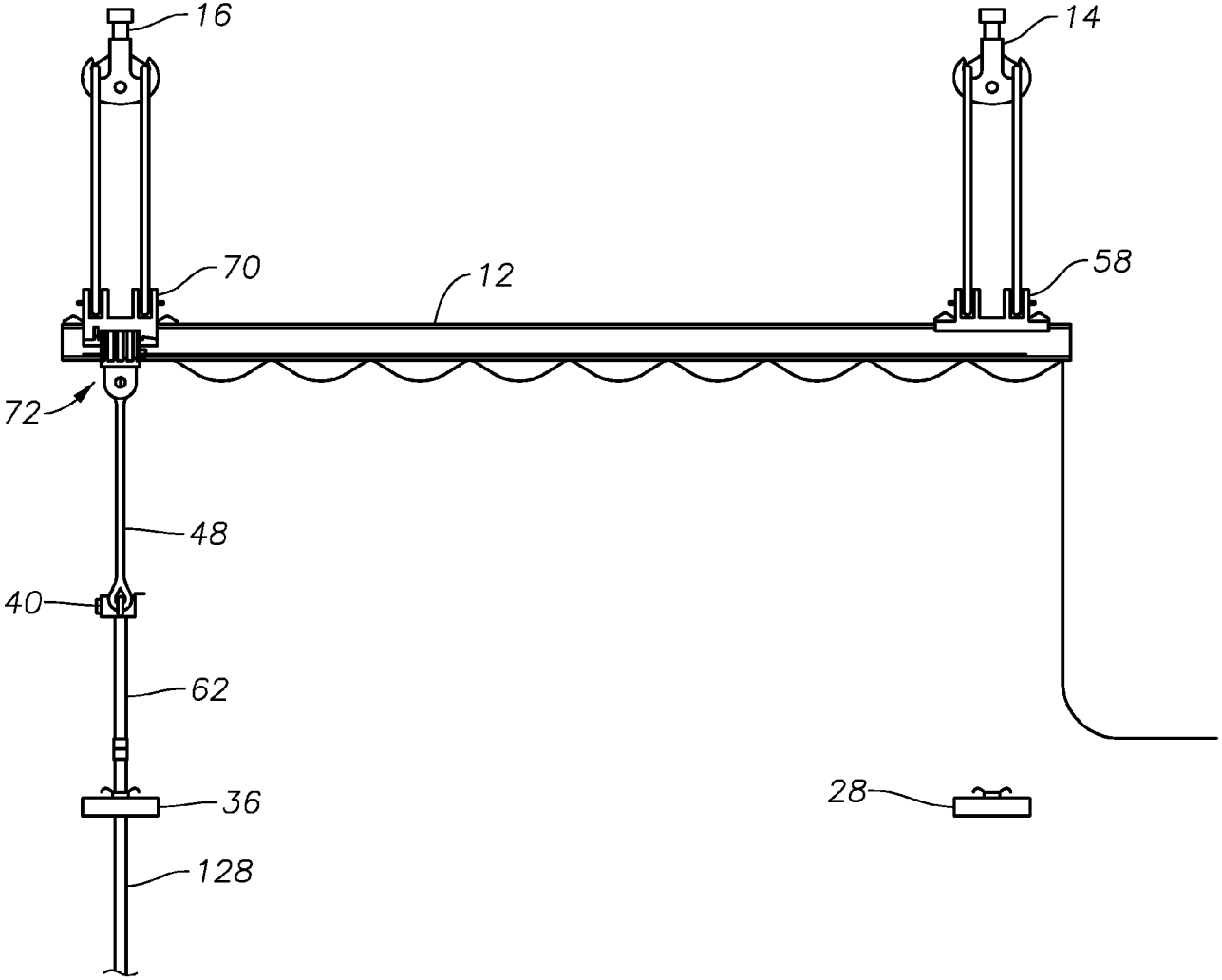
FIG. 19 is a front view of the drilling rig transfer system of FIG. 7 lowering the device for connection to a string located in the second location.
Figure 20:
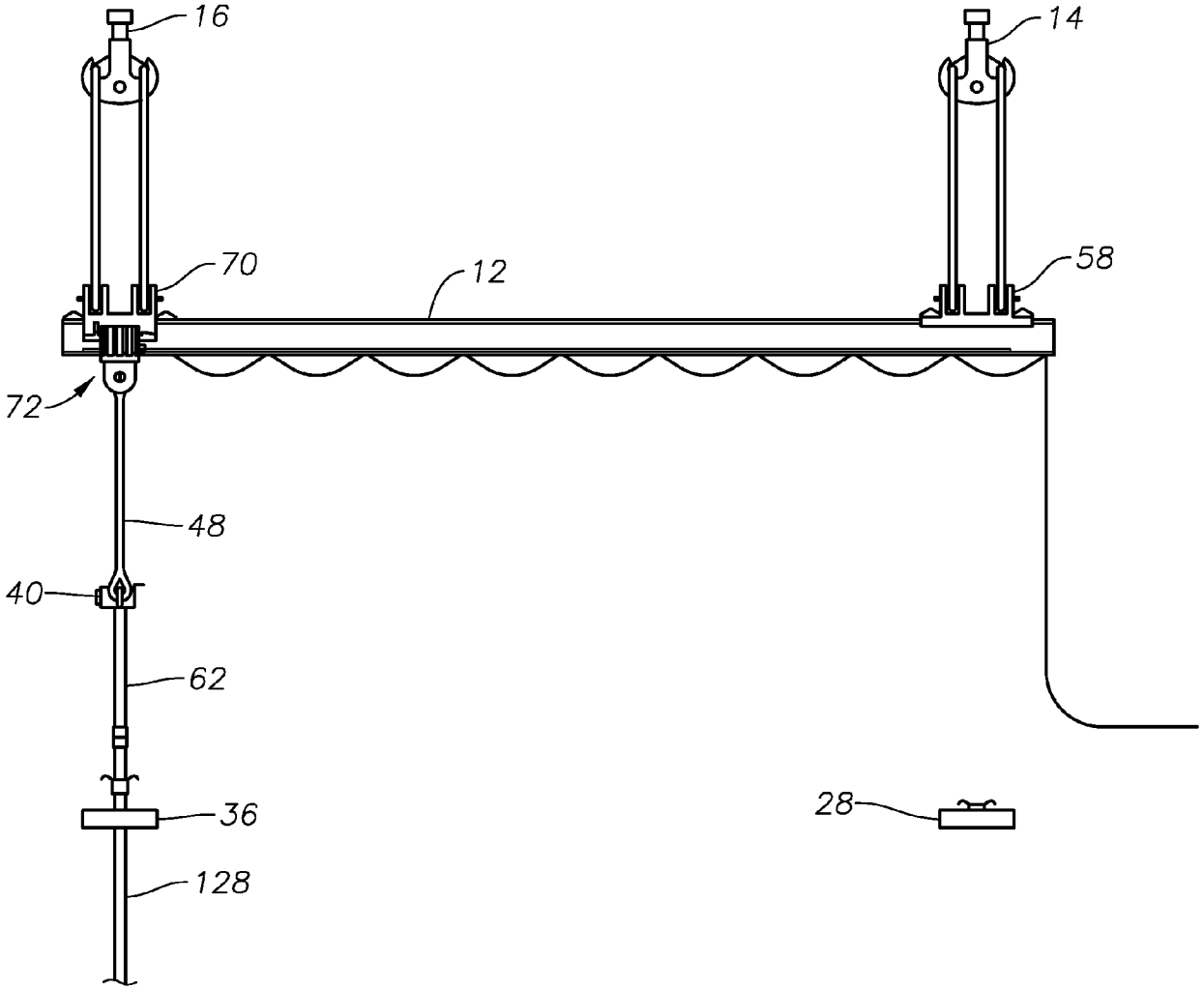
FIG. 20 is a front view of the drilling rig transfer system of FIG. 7 lifting the device and the string from the second location.
Figure 21:
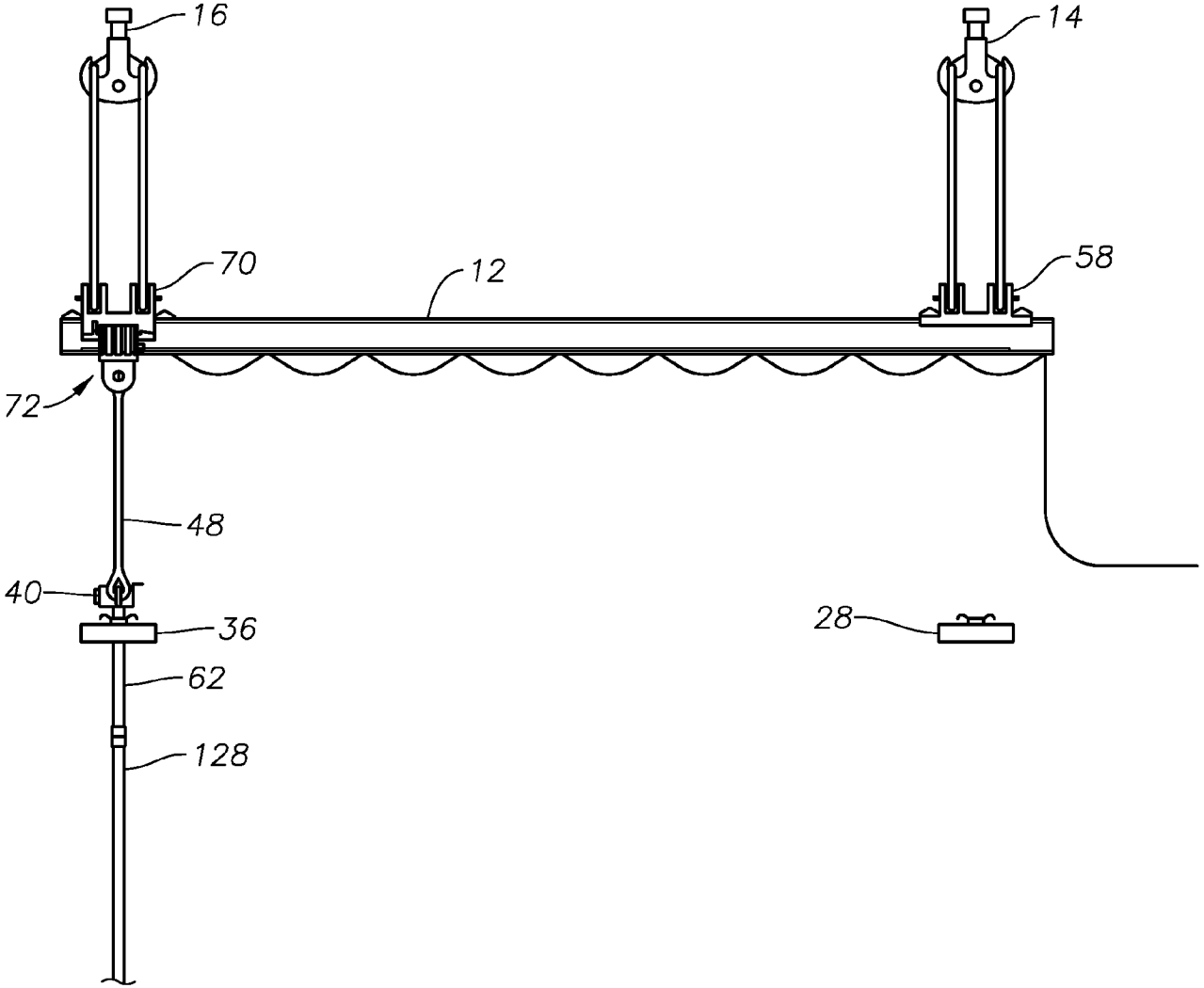
FIG. 21 is a front view of the drilling rig transfer system of FIG. 7 lowering the device and the string such that the device is secured in the second location.
Figure 22:
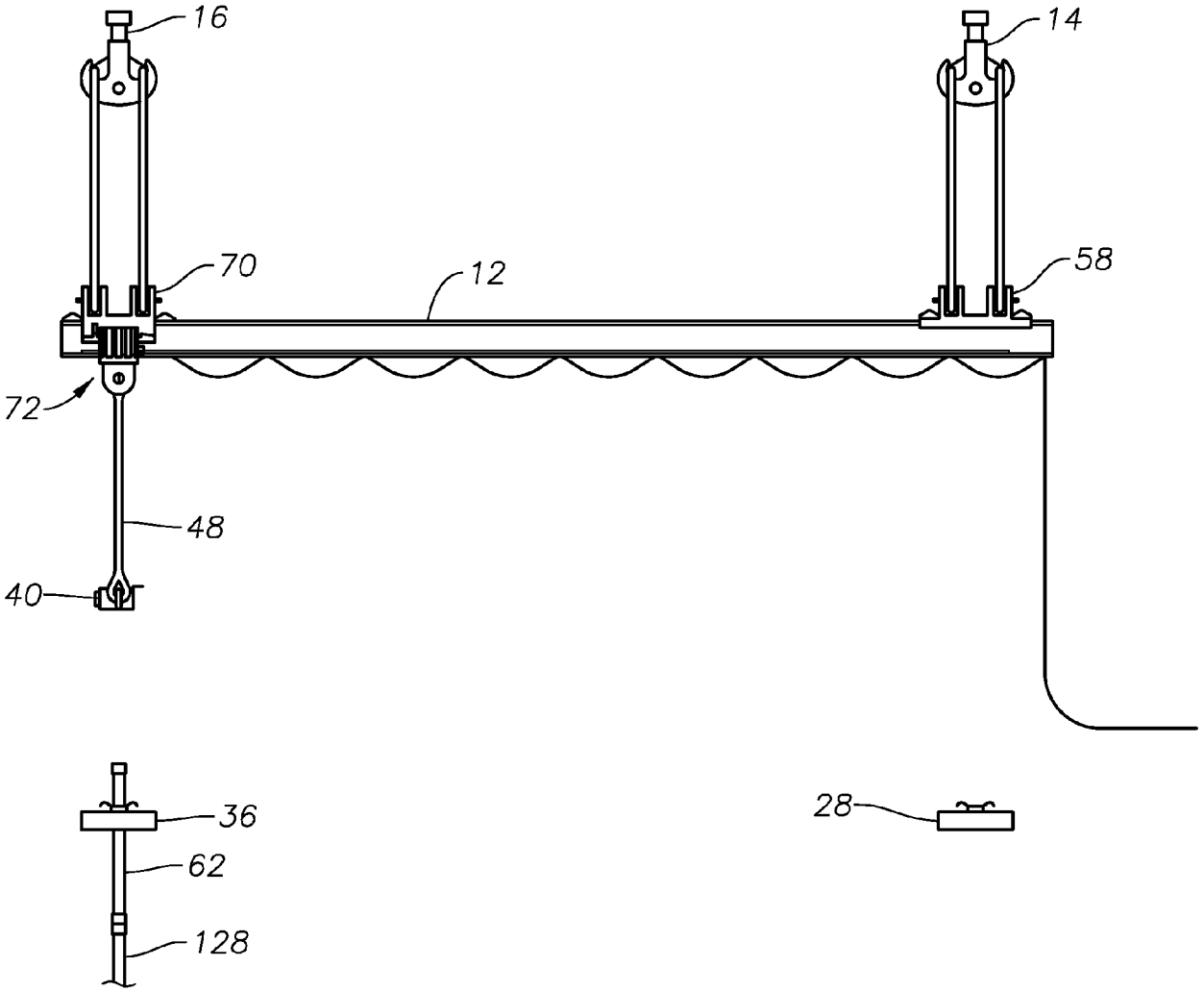
FIG. 22 is a front view of the drilling rig transfer system of FIG. 7 after disconnecting from the device in the second location.

Connection mechanism 40 and device 62 may be lifted to the position shown in FIG. 17 by raising first traveling block 14 and second traveling block 16 until a lower end of device 62 is removed from first location 28. Connection mechanism 40 and device 62 may then be transferred from above first location 28 to a position above second location 36 as shown in FIG. 18 by moving trolley assembly 72 along mobile transfer beam 12 to second suspension position 34. Device 62 may then be lowered to an upper end of string 128 that is positioned in second location 36 by lowering first traveling block 14 and second traveling block 16 to the position shown in FIG. 19. String 128 may be any tubular string, such as a completion string or tubing string, to which device 62 will be attached. A lower end of device 62 may be attached to an upper end of string 128 (e.g., by threaded connection or flanged connection) as shown in FIG. 19. Where string 128 is suspended from a rotary table at second location 36 and secured therein with slips as shown, device 62 and string 128 may be lifted by lifting first traveling block 14 and second traveling block 16 such that the slips are removed from the rotary table as shown in FIG. 20. When device 62 and string 128 are lifted, the load on trolley assembly 72 may increase significantly due to the weight of string 128. For example, the weight of device 62 may be around 40 tons, while the weight of string 128 may be up to 350 tons. These weights may vary, and drilling rig transfer system 10 may be adjusted accordingly as understood by one of ordinary skill in the art. Where the increased load is greater than a predetermined load of the compression mechanism, trolley assembly 72 may be placed in the locked position as shown in FIG. 12. In the locked position, the increased load may be transferred directly from trolley assembly 72 to second suspension mechanism 70 through the engagement of upper extensions 106, 108 of base 98 and extensions 80, 82 of second suspension mechanism 70. After the slips are removed, device 62 and string 128 may be lowered to a position in which device 62 is secured in the rotary table with the slips and string 128 is suspended below device 62 as shown in FIG. 21. Connection mechanism 40 may then be disconnected from device 62 as shown in FIG. 22. In this way, the alternate embodiment of drilling rig transfer system 10 may transfer a device from a first location to a second location, and lift an entire landing string when needed.

Any of the above-described alternatives for materials, equipment, or method steps may be used alone or in combination with any of the other above-described alternatives. While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A drilling rig transfer system comprising:

a mobile transfer beam including a first suspension position and a second suspension position, wherein the mobile transfer beam is suspended from a first traveling block through a first connection at the first suspension position, and wherein the mobile transfer beam is suspended from a second traveling block through a second connection at the second suspension position;

a trolley assembly operatively attached to the mobile transfer beam, wherein the trolley assembly is moveable along the mobile transfer beam; and a connection mechanism suspended below the trolley assembly for connecting to and lifting a device below the mobile transfer beam on a drilling rig.

2. The drilling rig transfer system of claim 1, further comprising:

a first suspension mechanism operatively connected to the mobile transfer beam at the first suspension position for selective attachment to a first connection line suspended from the first traveling block; and a second suspension mechanism operatively connected to the mobile transfer beam at the second suspension position for selective attachment to a second connection line suspended from the second traveling block.

3. The drilling rig transfer system of claim 2, wherein the first suspension mechanism and the second suspension mechanism each comprises a downward facing hook.

4. The drilling rig transfer system of claim 2, wherein the first suspension mechanism comprises a pin for attachment of the first suspension mechanism to the first connection line, and wherein the second suspension mechanism comprises a pin for attachment of the second suspension mechanism to the second connection line.

5. The drilling rig transfer system of claim 2, wherein the trolley assembly comprises a base operatively connected to the mobile transfer beam, a trolley suspension mechanism operatively attached below the base, and a trolley connection line suspended from the trolley suspension mechanism, wherein the base is moveable along the mobile transfer beam, and wherein the connection mechanism is operatively connected to a lower end of the trolley connection line.

6. The drilling rig transfer system of claim 5, wherein the trolley connection line comprises an upper aperture dimensioned to engage an upward facing hook of the trolley suspension mechanism.

7. The drilling rig transfer system of claim 5, wherein the trolley suspension mechanism comprises a pin for attachment of the trolley connection line.

8. The drilling rig transfer system of claim 5, wherein the mobile transfer beam further includes a horizontal extension, and wherein the trolley assembly further includes one or more rollers operatively connected to the base and disposed above the horizontal extension of the mobile transfer beam for facilitating movement of the base along the mobile transfer beam.

9. The drilling rig transfer system of claim 5, wherein the second suspension mechanism comprises an extension having a locking mechanism for selectively preventing movement of the trolley assembly along the mobile transfer beam, wherein the second suspension mechanism is operatively connected to an upper end of the mobile transfer beam through a compression mechanism.

10. The drilling rig transfer system of claim 9, wherein the compression mechanism comprises a hydraulic cylinder, a spring, a Belleville washer, an accumulator, or a shock absorber.

11. The drilling rig transfer system of claim 9, wherein the second suspension mechanism further comprises a cavity having an upper end of the mobile transfer beam disposed therethrough, wherein the base of the trolley assembly comprises a cavity and an upper extension dimensioned to selectively engage the extension of the second suspension mechanism, wherein a lower end of the mobile transfer beam and the extension of the second suspension mechanism are disposed through the cavity of the base, wherein the locking mechanism of the extension of the second suspension mechanism is configured to engage the upper extension of the base in order to prevent movement of the trolley assembly along the mobile transfer beam when a load exceeding a predetermined amount is applied to the trolley assembly.

12. The drilling rig transfer system of claim 1, further comprising a second trolley assembly operatively attached to the mobile transfer beam, wherein the second trolley assembly is moveable along the mobile transfer beam.

13. The drilling rig transfer system of claim 1, further comprising a set of legs and a platform each dimensioned to selectively engage a lower end of the mobile transfer beam in order to stabilize the drilling rig transfer system for transportation.

14. A method of transferring a device from a first location to a second location on a drilling rig, wherein the drilling rig comprises a drilling rig transfer system comprising a mobile transfer beam including a first suspension position and a second suspension position, a trolley assembly operatively attached to the mobile transfer beam, and a connection mechanism suspended below the trolley assembly for connecting to and lifting a device below the mobile transfer beam, wherein the trolley assembly is moveable along the mobile transfer beam, the mobile transfer beam being suspended from a first traveling block positioned over the first location through a first connection at the first suspension position, and being suspended from a second traveling block positioned over the second location through a second connection at the second suspension position, the method comprising:

positioning the connection mechanism and the trolley assembly over the first location;

lowering the connection mechanism by lowering the first traveling block and the second traveling block in order to position the connection mechanism near an upper end of a device disposed at the first location;

attaching the connection mechanism to the upper end of the device disposed at the first location;

lifting the connection mechanism and the device by raising the first traveling block and the second traveling block such that the device is removed from the first location;

moving the trolley assembly along the mobile transfer beam to position the connection mechanism and the device over the second location; and lowering the device into the second location by lowering the first traveling block and the second traveling block.

15. The method of claim 14, wherein the transfer system further comprises a first suspension mechanism operatively connected to the first suspension position of the mobile transfer beam and a second suspension mechanism operatively connected to the second suspension position of the mobile transfer beam, and wherein the method further comprises attaching the first suspension mechanism to a first connection line suspended from the first traveling block and attaching the second suspension mechanism to a second connection line suspended from the second traveling block.

16. The method of claim 15, further comprising positioning a downward facing hook of the first suspension mechanism through an aperture in a lower end of the first connection line and positioning a downward facing hook of the second suspension mechanism through an aperture in a lower end of the second connection line.

17. The method of claim 15, wherein the trolley assembly comprises a base operatively connected to the mobile transfer beam, a trolley suspension mechanism operatively attached below the base, and a trolley connection line suspended from the trolley suspension mechanism, wherein the base is moveable along the mobile transfer beam, and wherein the method further comprises connecting the connection mechanism to a lower end of the trolley connection line.

18. The method of claim 17, wherein the second suspension mechanism comprises an extension having a locking mechanism, wherein the second suspension mechanism is operatively connected to an upper end of the mobile transfer beam through a compression mechanism, wherein the base of the trolley assembly comprises an upper extension dimensioned to selectively engage the extension of the second suspension mechanism, wherein a first rotary table is disposed at the first location and a second rotary table is disposed at the second location, wherein the method further comprises:

lowering the connection mechanism by lowering the first traveling block and the second traveling block in order to position the connection mechanism near an upper end of a device disposed in the first rotary table;

attaching the connection mechanism to the upper end of the device disposed in the first rotary table;

lifting the connection mechanism and the device by raising the first traveling block and the second traveling block such that the device is removed from the first rotary table;

moving the trolley assembly along the mobile transfer beam to position the connection mechanism and the device over the second rotary table;

lowering the device to a tubular string disposed in the second rotary table by lowering the first traveling block and the second traveling block, wherein the tubular string is secured to the second rotary table with slips;

attaching a lower end of the device to an upper end of the tubular string;

lifting the connection mechanism, the device, and the tubular string by raising the first traveling block and the second traveling block such that the slips are removed from the second rotary table, wherein the compression mechanism is compressed upon lifting the tubular string such that the upper extension of the trolley assembly engages the locking mechanism of the extension of the second suspension mechanism in order to prevent the trolley assembly from moving along the mobile transfer beam while the tubular string is supported by the connection mechanism; and lowering the connection mechanism, the device, and the tubular string to a position in which the device is disposed in the second rotary table by lowering the first traveling block and the second traveling block.

19. The method of claim 17, wherein the trolley assembly further comprises one or more rollers operatively connected to the base, and wherein the method further comprises rolling the rollers of the trolley assembly along an upper surface of a horizontal extension of the mobile transfer beam in order to move the trolley assembly along the mobile transfer beam.

20. The method of claim 14, wherein a first rotary table is disposed at the first location and a second rotary table is disposed at the second location, wherein the method further comprises:

lowering the connection mechanism by lowering the first traveling block and the second traveling block in order to position the connection mechanism near an upper end of a device disposed in the first rotary table;

attaching the connection mechanism to the upper end of the device disposed in the first rotary table;

lifting the connection mechanism and the device by raising the first traveling block and the second traveling block such that the device is removed from the first rotary table;

moving the trolley assembly along the mobile transfer beam to position the connection mechanism and the device over the second rotary table; and lowering the device into the second rotary table by lowering the first traveling block and the second traveling block.

21. A method of transferring a device from a first location to a second location on a drilling rig, wherein the drill rig comprises a drilling rig transfer system comprising a mobile transfer beam including a first suspension position and a second suspension position, a trolley assembly operatively attached to the mobile transfer beam, a connection mechanism suspended below the trolley assembly, and a lifting assembly positioned between the trolley assembly and the connection mechanism configured to raise and lower the connection mechanism relative to the transfer beam, wherein the trolley assembly is moveable along the mobile transfer beam, the mobile transfer beam being suspended from a first traveling block positioned over the first location through a first connection at the first suspension position, and being suspended from a second traveling block positioned over the second location through a second connection at the second suspension position, the method comprising:

positioning the connection mechanism over the first location;

lowering the connection mechanism using the lifting assembly to position the connection mechanism near an upper end of a device disposed at the first location;

attaching the connection mechanism to the upper end of the device disposed at the first location;

lifting the connection mechanism and the device using the lifting assembly such that the device is removed from the first location;

moving the trolley assembly along the mobile transfer beam to position the connection mechanism and the device over the second location; and lowering the device into the second location using the lifting assembly.

22. The method of claim 21, wherein a first rotary table is disposed at the first location and a second rotary table is disposed at the second location, wherein the method further comprises:

lowering the connection mechanism using the lifting assembly to position the connection mechanism near an upper end of a device disposed in the first rotary table;

attaching the connection mechanism to the upper end of the device disposed in the first rotary table;

lifting the connection mechanism and the device using the lifting assembly such that the device is removed from the first rotary table;

moving the trolley assembly along the mobile transfer beam to position the connection mechanism and the device over the second rotary table; and lowering the device into the second rotary table using the lifting assembly.

* * * * *